US008336453B2

(12) United States Patent
Strautmann

(10) Patent No.: US 8,336,453 B2
(45) Date of Patent: Dec. 25, 2012

(54) PRESS HAVING A LOADING DEVICE AND A DEVICE FOR OPENING AND REMOVING GOOD PIECES

(75) Inventor: Wolfgang Strautmann, Bad Laer (DE)

(73) Assignee: SIB Strautmann Ingenieurbuero GmbH, Glandorf (DE)

( * ) Notice: Subject to any disclaimer, the term of this patent is extended or adjusted under 35 U.S.C. 154(b) by 506 days.

(21) Appl. No.: 12/531,580

(22) PCT Filed: Feb. 29, 2008

(86) PCT No.: PCT/EP2008/001609
§ 371 (c)(1),
(2), (4) Date: Sep. 16, 2009

(87) PCT Pub. No.: WO2008/113465
PCT Pub. Date: Sep. 25, 2008

(65) Prior Publication Data

US 2010/0095857 A1 Apr. 22, 2010

(30) Foreign Application Priority Data

| | | |
|---|---|---|
| Mar. 19, 2007 | (DE) | 20 2007 004 201 U |
| May 3, 2007 | (DE) | 10 2007 021 097 |
| Aug. 10, 2007 | (DE) | 10 2007 038 012 |
| Sep. 25, 2007 | (DE) | 10 2007 045 939 |

(51) Int. Cl.
*B30B 9/30* (2006.01)
*B30B 15/30* (2006.01)

(52) U.S. Cl. ..... 100/215; 100/96; 100/98 R; 100/156; 100/226

(58) Field of Classification Search ..... 100/94, 100/96, 97, 98 R, 104, 121, 215, 226, 240, 100/245, 156; 241/99, 100, 185.5, 187, 225, 241/233, 236, 243
See application file for complete search history.

(56) References Cited

U.S. PATENT DOCUMENTS

| | | | | |
|---|---|---|---|---|
| 2,604,034 | A * | 7/1952 | Hess | 100/98 R |
| 3,651,755 | A * | 3/1972 | Gati | 100/96 |
| 3,951,059 | A * | 4/1976 | Morris | 100/173 |

(Continued)

FOREIGN PATENT DOCUMENTS

| | | |
|---|---|---|
| DE | 7625603 | 9/1977 |
| DE | 2612483 | 10/1977 |
| DE | 3428693 | 2/1986 |
| DE | 103 25 368 | 11/2004 |

(Continued)

*Primary Examiner* — Jimmy T Nguyen
(74) *Attorney, Agent, or Firm* — Greer, Burns & Crain Ltd.

(57) ABSTRACT

The invention relates to a press having a loading device, wherein the press is configured particularly for pressing the pressing product forming residual or recyclable materials, such as used paper, cardboard, plastic bottles, foils and the like, and has a press housing including a pressing chamber, having a loading opening for feeding the pressing product and a pressing shield displaceable in the pressing chamber, wherein the loading device includes at least one rotatably driveable rotor roller equipped with conveying prongs. By means of a rotation of the roller pressing product can be conveyed from the outside of the press housing through the loading opening into the pressing chamber. The press has the rotor roller is disposed directly in front of or in the loading opening of the press. The loading device has a feeding space connected upstream of the rotor roller. The pressing product to be pressed can be placed or thrown into the space and wherein the pressing product can be removed from the same by the rotor roller directly into the pressing chamber.

47 Claims, 15 Drawing Sheets

U.S. PATENT DOCUMENTS

| | | | | |
|---|---|---|---|---|
| 4,573,403 | A | | 3/1986 | Van Doorn et al. |
| 4,987,829 | A | | 1/1991 | Hudson |
| 5,195,429 | A | | 3/1993 | Firpo |
| 5,558,284 | A | * | 9/1996 | Baumung et al. ..... 241/101.741 |
| 5,890,424 | A | * | 4/1999 | Deters ..... 100/37 |
| 6,491,245 | B1 | | 12/2002 | Rajewski |
| 6,588,688 | B1 | | 7/2003 | Rössler |
| 2006/0288886 | A1 | | 12/2006 | Schwelling |

FOREIGN PATENT DOCUMENTS

| | | |
|---|---|---|
| DE | 202004010128 | 11/2005 |
| JP | 9168897 | 6/1997 |
| JP | 10286827 | 10/1998 |
| JP | 11070525 | 3/1999 |
| JP | 2004223609 | 8/2004 |
| NL | 7600345 | 8/1976 |

* cited by examiner

PRESS HAVING A LOADING DEVICE AND A DEVICE FOR OPENING AND REMOVING GOOD PIECES

CROSS REFERENCE TO RELATED APPLICATIONS

This application claims the benefit of German patent applications numbers 20 2007 004 201.9 filed Mar. 19, 2007, 10 2007 021 097.5 filed May 3, 2007, 10 2007 038 012.9 filed Aug. 10, 2007 and 10 2007 045 939.6 filed Sep. 25, 2007, the entire disclosures of which are incorporated herein by reference.

BACKGROUND OF THE INVENTION

The present invention relates to a press having a loading device, wherein the press is configured particularly for pressing the pressing product forming residual or recyclable materials, such as used paper, cardboard, plastic bottles, foils and the like, and has a press housing comprising a pressing chamber, having a loading opening for feeding the pressing product and a pressing shield displaceable in the pressing chamber, wherein the loading device comprises at least one rotatably driveable rotor roller equipped with conveying prongs, wherein by means of a rotation of said roller pressing product can be conveyed from the outside of the press housing through the loading opening into the pressing chamber. Furthermore, the invention relates to a device for opening and emptying good pieces.

The use of baling presses is widespread for reducing the transport volume of recyclable materials. For example, such baling presses are used to press cardboard, foils or like packaging material. Commercial enterprises often use so-called vertical baling presses. Usually, these vertical baling presses comprise three stationary side walls which are, in turn, permanently connected to a base plate; the fourth lateral wall has a lower door which closes the pressing chamber and can be opened for removing the bales and an upper door which optionally clears or closes a loading opening. During operation of the press, the doors are closed. At its top, the pressing chamber is limited by the press shield which can be vertically displaced therein and remains at the upper end position while the pressing chamber is being filled.

Theoretically, the pressing chamber can be divided into a pressing region and a feeding region. To fill the press, the upper door closing the feeding region is opened and the pressing product to be pressed is placed in by an operator. This door of the loading opening can also be a part or section of the lower door for the pressing chamber. The upper door which acts as feeding door can be swiveled either about a horizontal or a vertical axis.

Where vertically operating baling presses are concerned, the pressing product to be pressed is inserted into the pressing chamber through this feeding door and stacked onto pressing product already present in the pressing chamber until the feeding space no longer provides any space for further pressing product. Thereafter, the upper door is closed and the press is started. After the pressing cycle has been completed, the operator can again insert pressing product into the pressing space. If wanting to feed pressing product for more press cycles than one, the operator always has to wait for completion of the press cycle before he can continue feeding thereafter. Since the quantities that can be refed are always small, the filling procedure is, occasionally, delayed over a prolonged period of time, thus being time-consuming and cost-intensive.

A further disadvantage must be seen in the fact that, while the upper door is being closed, pressing product still projecting through the loading opening and beyond the pressing chamber to the outside either impairs or, in the worst case, even prevents the closing of the feeding door, with the result that projecting pressing product must again be removed.

To eliminate these disadvantages, different technical solutions facilitating the filling of baling presses have been proposed. For example, the Applicant's earlier German Patent Application No. 10 2007 013 382.2 describes a device for producing pressed bales wherein, initially, a collecting space disposed outside of the press is filled, with the content of said collecting space then being dumped or pressed into the feeding region of the baling press by means of the floor of the collecting space, said floor being designed as a swivel plate. Therein, the swivel plate also forms the upper door of the pressing chamber.

Although this device normally provides a facilitated feeding procedure, machines of this design keep causing problems in practice. On the one hand, these problems can occur if the collecting space is overfilled with excessive quantities of pressing product because, in this case, the swivel plate cannot be closed completely any longer. If the pressing shield is now moving down to press the pressing product, pressing product possibly projecting through the loading opening and into the pressing chamber gets between pressing shield and door, this perhaps leading to an excessive stress of guides and drive elements of the pressing shield. On the other hand, an excessive quantity of fed pressing product possibly has a negative effect on the bale density; practical tests have shown that there is a positive correlation between the number of press strokes and the bale density with otherwise equal parameters.

DE 76 25 603 U shows a baling press with a feeding shaft and an infeed chute disposed therein for pressing product to be pressed. Spaced apart upwards from a loading opening of the pressing chamber, a rotatably driveable rotor with digging teeth is disposed at the lower end of the chute, the primary task of said rotor being a loosening of the pressing product and the secondary task of said rotor being a reduction of the pressing product to a certain degree. Therein, the direction of rotation of the rotor is such that, at a clear side of its circumference, the rotor conveys the pressing product in an "overhead" manner and hurls the pressing product against the wall of the feeding chute. From there, the loosened pressing product falls down through the loading opening and into the pressing chamber by the force of gravity. Herein, an optimum, i.e. dense, filling of the pressing chamber is not achieved; on the contrary, the purposeful loosening of the pressing product even generates a particularly loose filling of the pressing chamber with a low density, this increasing the number of press strokes required for one pressed bale and resulting in a low operating speed of the press.

DE 26 12 483 A1 shows an extrusion press with a loading device, which comprises two knife shafts which are disposed in parallel to and on top of each other, engage each other and are rotatably driveable in opposite directions. Together, the knife shafts form a cutting unit which is fed with pressing product via a feed table, said pressing product, for example, being paper material. The cutting unit pushes the cutting material delivered by the cutting unit through an outlet chute and into the pressing chamber where it is then compacted by an extrusion punch. This is to disadvantage in that two knife shafts having their own bearing means and having a drive driving both shafts are required, this resulting in a high technical complexity. What is more, the pressing product rubs against the chute walls in the outlet chute, this friction impeding the transport of the pressing product through the outlet chute and not allowing any efficient loading and filling of the pressing chamber.

SUMMARY OF THE INVENTION

The present invention, therefore, aims at creating a press which obviates the prior art drawbacks and allows achieving an optimization and automation of the press chamber filling procedure. The personnel-dependent operation complexity is to be minimized while simultaneously ensuring maximum operational reliability. Furthermore, the invention aims at creating a device for opening and emptying good pieces, which can be used independently of a press without having to meet special technical requirements.

To solve the part of this problem involving the press, the present invention proposes a press of the aforementioned type, characterized in that the rotor roller is disposed directly in front of and/or in the loading opening of the press, and that the loading device has a feeding space connected upstream of the rotor roller, wherein the pressing product to be pressed can be placed or thrown into said space and wherein the pressing product can be removed from the same by the rotor roller directly into the pressing chamber.

The press according to the invention is to advantage in that a rotor roller which is equipped with conveying prongs and disposed directly in front of and/or in the loading opening of the press is used for filling the pressing chamber. Said rotor roller is, appropriately, mounted on either side of the loading opening of the press. The conveying prongs seize the pressing product to be inserted and convey it directly into the pressing chamber in a compulsory manner, particularly without any interconnected conveying shaft or the like. Therein, it is to advantage that the rotor roller already brings about a precompaction of the pressing product. Said precompaction allows a larger filling volume of pressing product to be inserted into the pressing chamber, this ensuring a highly effective operation of the press and facilitating the subsequent pressing of the pressing product in the pressing chamber. Furthermore, the arrangement according to the invention allows achieving a compact design because the rotor roller is positioned very close to the pressing chamber. Since the loading device has a feeding space upstream of the rotor roller wherein the pressing product to be pressed can be placed or thrown into said space and wherein the pressing product can be removed from the same by the rotor roller directly into the pressing chamber, the supply of pressing product to the press is facilitated for operators and is, at the same time, particularly safe because the feeding space makes it practically impossible for an operator to reach into the working range of the rotor roller with his hands or arms.

Preferably, it is furthermore provided that the loading opening has a width which is equal to an inner width of the pressing chamber and that the part of the rotor roller that is equipped with conveying prongs has an axial length which is equal to the width of the loading opening, as measured in parallel to the rotor roller. This matching of the dimensions of the aforementioned parts of the press and its loading device allows achieving that the pressing chamber is uniformly loaded with pressing product over its entire width, with the result that any accumulation of material in a central region of the pressing chamber is prevented or at least reduced. The uniform loading of the pressing chamber over its entire width allows ensuring that the pressed bales produced in the pressing chamber obtain a largely uniform and high pressing density, as seen over their entire cross-sectional area. Due to this advantageous uniformly high pressing density, a predefined volume of a pressed bale can be utilized in an optimum manner and a maximum possible amount of pressing product is accommodated in one pressed bale. In addition, the pressed bale thus produced is dimensionally stable without requiring any major complexity in terms of ties, this preventing any undesired subsequent falling and scattering of individual parts of the pressing product out of the pressed bale during the storage and transport thereof.

Furthermore, the invention proposes that the feeding space has a width which is equal to the width of the loading opening, as measured in parallel to the rotor roller. This ensures that, on its input side, the rotor roller is uniformly supplied with pressing product to be pressed over its full conveying length. This also contributes to uniformly filling the pressing chamber, as seen over the cross-section thereof.

As an alternative to the aforementioned embodiment of the press, it is proposed that, as measured in parallel to the rotor roller, the feeding space has a width that is in excess of the width of the loading opening and that one lateral guiding device each is allocated to each end face region of the rotor roller, wherein pressing product can be guided from lateral edge regions of the feeding space towards an inner region by means of said lateral guiding devices. This embodiment of the press allows achieving that pressing product in the edge regions of the rotor roller and the loading opening is concentrated by means of the lateral guiding devices, with the result that the edge regions of the pressed bale subsequently produced in the pressing chamber obtain a particularly high density. In this manner, a shortage of pressing product in lateral regions of the pressing chamber is prevented particularly efficiently.

To ensure that the pressing product can be guided from the lateral edge regions of the feeding space towards an inner region in an as unimpeded manner as possible, as has been mentioned in the above paragraph, the rotor roller preferably has at least one prongless circumferential section in its equipment of conveying prongs in each of its axial end regions, as seen in circumferential direction. The prongless circumferential sections of the rotor roller do not form any impediment for the inward movement of the pressing product whereby the desired conveyance is safely achieved.

In a first further development, each guiding device can be designed as a passive device and can each be formed by one inclined guide wall which is disposed upstream of the rotor roller. Such a guide wall is a very simple component and can be installed in the feeding space with a low complexity in terms of manufacture and assembly. Therein, the guide walls can be designed as flat walls or also as walls extending in a curve. Therein, the guide walls can be designed as separate single parts or they can also be formed integrally, in particular in a single piece, with the lateral walls of the feeding space. While being active, a conveying means allocated to the feeding space ensures that, during its movement towards the rotor roller, the pressing product is moved from the lateral edge regions of the feeding space towards an inner region, i.e. towards the center of the feeding space, in a compulsory manner by means of the guide walls and is, therefore, concentrated near the end face regions of the rotor roller before being seized by the rotor roller and being conveyed into the pressing chamber.

Alternatively, each guiding device can be designed as an active device and can each be formed by a conveyor screw section which is disposed at the end side of the rotor roller. To ensure that the above conveyance effect from the lateral edge regions towards an inner region is achieved, the two conveyor screw sections are formed in opposite directions, wherein the conveying direction of the conveyor screw sections is, as a matter of course, selected such that, during rotation of the rotor roller in its conveying direction, the two conveyor screw sections disposed thereon are each conveying towards the center of the rotor roller. A separate drive for the active guiding device is not required because the already existing drive of the rotor roller also assumes the task of driving the active guiding device. If prongless circumferential sections of the rotor roller are provided at the same time, these sections are, appropriately, positioned in an axially inward direction from the conveyor screw sections.

To achieve a stable and effective design of the rotor roller with easy producibility, it is provided that the conveying prongs of the rotor roller are formed by disks which are attached onto a jacket tube of the rotor roller in a non-rotatable manner and are spaced apart from each other axially, said disks being toothed or serrated in a radially outward direction.

A further embodiment provides that the feeding space is formed by a box which is open at its top and has an opening towards the rotor roller at its side facing the loading opening of the press. This is to achieve that pressing product, once it is inserted in the feeding space, can no longer exit from said space to the outside in an undesired manner but is safely supplied to the rotor roller and is conveyed into the pressing chamber by said rotor roller. Where free-flowing pressing product is concerned, the rotor roller is, appropriately, disposed in the lower part of the feeding space. Here, the pressing product falls into the working range of the conveying prongs of the rotor roller through its own weight and is then taken by said conveying prongs.

Where non-free-flowing pressing product is concerned, it is expedient to support the supply of pressing product to the rotor roller or effect said supply in a compulsory manner. To achieve this and to ensure in a particularly reliable manner that all of the pressing product inserted in the feeding space is supplied into the working range of the rotor roller even if the feeding spaces are large, the invention proposes that a conveying device which allows supplying pressing product inserted in the feeding space to a pressing product reception region of the rotor roller is disposed in the feeding space.

The feeding space and the conveying device disposed therein can have different embodiments. A first embodiment provides that the feeding space has a flat floor and that the conveying device is formed by a conveying shield linearly displaceable in the feeding space by means of a mechanical drive.

Alternatively, it is proposed that the feeding space has a floor that is curve in the form of a cylinder jacket section and that the conveying device is formed by a conveying shield that can be swiveled in the feeding space by means of a mechanical drive, the swivel axis of said conveying shield coinciding with a central axis of the cylinder jacket section.

According to a further alternative, the conveying device comprises an arrangement of one or a plurality of driveable conveyor chains.

In order to increase the conveying effect, the conveyor chains can, at least in part, be equipped with carrier tools.

It is also conceivable that the conveying device comprises a driveable scraper floor conveyor.

Last but not least, the conveying device can also comprise driveable conveyor screws.

As regards the drive of the conveying device, it is provided according to a first technically simple embodiment that the conveying device in the feeding space can be switched on and off and/or adjusted in its conveying capacity independently of the rotor roller or its rotary drive. The switching and/or adjusting of the conveying capacity can, for example, be effected by an operator.

A further embodiment provides that the conveying device in the feeding space can be switched on and off and/or adjusted in its conveying capacity in relation to a power consumption of the rotor roller drive or in relation to a torque of the rotor roller. As a result, the load of the rotor roller provides a criterion for switching the conveying device on and off, wherein the conveying device is switched off or, alternatively, reduced in its capacity if the load of the rotor roller is high, whereas the conveying device is switched on or its capacity increased if the load of the rotor roller is low. In this manner, the load of the rotor roller can be automatically kept within an optimum range, e.g. by means of an electronic control unit.

To operate the press economically, it is desirable that the pressing chamber is always loaded in a fast and efficient manner in order to avoid undesired time variations during loading and in order to ensure a high efficiency of the press even if conveying of the pressing product is difficult. A contribution to achieve this is made by an embodiment of the press which is characterized in that an auxiliary conveying device is disposed above the conveying device spaced apart therefrom and, as seen in the pressing product conveying direction, upstream of the rotor roller, said auxiliary conveying device exerting a conveying and/or compressing effect on the upper side of the pressing product supplied by the conveying device. This is to advantage in that, as a result, the rotor roller reliably seizes the pressing product conveyed towards the rotor roller and conveys said pressing product into the pressing chamber of the press, wherein pressing product is prevented from gliding or falling back from a pressing product reception region of the rotor roller in an undesired manner. In combination with the conveying device in the feeding space, the auxiliary conveying device ensures that the pressing product is conveyed to the rotor roller in a compulsory manner without the pressing product being able of giving way in any direction whatsoever. In this manner, a conveyance of pressing product into the pressing chamber is achieved that is extremely uniform and constantly high over time, this contributing to a high economic efficiency of the press.

In a further development, the invention proposes that the auxiliary conveying device is formed by at least one conveying roller. This conveying roller can be used to exert, in a technically easy and reliable manner, the desired conveying effect and/or compression effect on the upper side of the pressing product conveyed to the rotor roller by the conveying device.

In order to ensure that the conveying roller can reliably exert its desired conveying effect on the pressing product, it is, furthermore, provided that the conveying roller has a surface at its circumference that is textured and/or provided with a friction-increasing covering, in particular a rubber coating.

In a further embodiment, it is proposed that the texture of the surface of the conveying roller is formed by conveying strips or conveying fingers or conveying prongs. Such a texture allows reliably exerting the desired conveying effect on the pressing product supplied to the rotor roller. In addition, the conveying roller allows exerting a compressing effect on the pressing product, with the result that, owing to a precompaction, said pressing product can be conveyed into the pressing chamber of the press by the rotor roller more easily.

Alternatively, the texture of the surface of the conveying roller can be formed by a conveying roller jacket extending in an undulating or zigzagging manner as seen in the circumferential direction of the conveying roller. Such a texture also allows achieving the desired conveying effect and/or compression effect.

As an alternative to a conveying roller, the auxiliary conveying device can, according to the invention, also be formed by at least one conveyor belt. If the auxiliary conveying device is formed as a conveyor belt, it is also possible to exert, in a technical simple and operationally reliable manner, the desired conveying effect and/or compression effect on the pressing product conveyed to the rotor roller by the conveying device.

A further embodiment proposes that the conveyor belt forming the auxiliary conveying device has a length which is less than half of a conveying length of the conveying device. This is to ensure that a sufficiently large area of the upper side of the feeding space is kept clear for throwing or placing pressing product pieces therein. In this manner, it is excluded that the insertion of the pressing product into the feeding space is rendered difficult or impeded.

The invention, furthermore, proposes that the conveyor belt forming the auxiliary conveying device forms an acute angle with the pressing product conveying direction of the conveying device, with the distance of the conveyor belt from the conveying device becoming smaller in the pressing product conveying direction. In this manner, the path traveled by the pressing product during its conveyance towards the rotor roller becomes narrower in conveying direction, whereby a desired precompression of the pressing product is achieved. In addition, the friction of the pressing product against the conveyor belt is increased in this manner, this ensuring a reliable conveying effect of the conveyor belt on the pressing product. If the conveying device in the feeding space is also formed by a conveyor belt, the conveying effect on the side of the conveyor belt forming the conveying device is also increased by the precompression of the pressing product.

Furthermore, it is preferably provided that the conveying device and the auxiliary conveying device are driveable with the same conveying speed. In this manner, any unnecessary friction of the conveying device or the auxiliary conveying device against the pressing product is prevented. As a result, dust formation and noise emission of the press can be reduced.

To this end, a further embodiment proposes that the conveying device and the auxiliary conveying device have a common branching drive. This keeps the mechanical construction of the drive of the conveying device and the auxiliary conveying device simple and ensures that an equal conveying speed of conveying device and auxiliary conveying device is, herein, maintained with low complexity.

In order to be able to adjust the press and, in particular, the loading device to different types and properties of pressing products as easily as possible, the invention proposes that the position of the auxiliary conveying device can be adjusted at least in vertical direction in relation to the conveying device. By adjusting the position of the auxiliary conveying device, an adjustment to different pressing products can be achieved quickly and easily, in particular by means of trials. As a result, it is possible to always achieve optimum operation of the loading device and, therefore, of the press as a whole, irrespective of the type of the particular pressing product to be processed.

Furthermore, it is provided according to the invention that the auxiliary conveying device is connected to the remaining press via detachable connecting means in a removable manner. In this embodiment, the press can, optionally, be equipped and operated with or without conveying device, this facilitating the manufacture of different embodiments of the press by the manufacturer. An embodiment of the press without the auxiliary conveying device suffices for pressing products not requiring the application of an auxiliary conveying device; if it is intended to process a pressing product that can be conveyed with difficulties only, the otherwise unchanged press is equipped with the additional auxiliary conveying device. Herein, it is also possible to subsequently change the press from one embodiment to the other embodiment, either at the press user's or by the press user.

For the purpose of reliably conveying the pressing product by means of the rotor roller, it is proposed that at least one guiding surface cooperating with the conveying prongs of the rotor roller is provided in a working range of the rotor roller, wherein the pressing product can be conveyed through between the guiding surface and an outer circumference of the rotor roller or a jacket tube of the rotor roller by means of the conveying prongs. The guiding surface ensures that the pressing product cannot give way to the conveying prongs but is safely seized and transported by the conveying prongs by the conveying prongs piercing into or through the pressing product.

In order to increase the conveying effect and achieve a precompaction, slots are appropriately provided in the guiding surface, with the conveying prongs immersing in said slots during the rotation of the rotor roller over at least a part of their length. The conveying prongs can then completely pierce through the pressing product without colliding with the guiding surface.

In order to keep the manufacture of the guiding surface simple and to be able to make repairs at a low price if necessary, the guiding surface preferably comprises individual guiding plates which are set spaced apart from each other.

In terms of a good precompaction of the pressing product, it is favorable curve the guiding surface and to approximate the bending radius of the guiding surface to the curved radius of a jacket tube of the rotor roller, at least in a pressing product discharge region.

Therein, it is furthermore preferably provided that, as seen in the pressing product conveying direction, the curve radius of the guiding surface is continuously decreasing from a feeding-space-sided beginning of the guiding surface to the pressing-chamber-sided end thereof. As a result, a gap between the rotor roller and the guiding surface becomes constantly narrower, as seen in the pressing product conveying direction, this promoting the precompaction of the pressing product and advantageously evening out the load of the rotor roller and its drive.

In order to prevent pressing product from sticking to the rotor roller in a disturbing manner, at least one stripper arrangement cooperating with the conveying prongs of the rotor roller is, appropriately, provided at the loading device. The stripper arrangement can, for example, be formed by stationary stripper fingers projecting in between the disks of the rotor roller, said disks bearing or forming the conveying prongs. The stripper arrangement particularly serves to strip the supplied pressing product from the conveying prongs in the vicinity of the loading opening of the baling press and conveying it into the pressing chamber. The pressing product that has been stripped from the rotor roller in the immediate vicinity of the loading opening is, then, pressed further into the pressing chamber by following further pressing product. If the press is a vertically operating press, the pressing shield is, therein, positioned above the loading opening in the pressing chamber.

In order to ensure that the pressing product conveyed into the pressing chamber is reliably discharged or thrown off there by the rotor roller, it is provided that the stripper arrangement forms a cage around the rotor roller and that, with its conveying prongs, the rotor roller extends over a circumferential region inside this cage, said circumferential region being positioned in the pressing product discharge region and, preferably, comprising 40 to 60 percent of the circumference of the rotor roller. In this manner, it is achieved that, in the pressing product discharge region, the conveying prongs are positioned inside the cage and cannot come into engagement with the pressing product any longer; that means that, herein, the stripper arrangement separates the pressing product from the conveying prongs in a compulsory manner. In the pressing product reception region, however, the conveying prongs are exposed and can efficiently come into engagement with the pressing product there.

In order to keep the manufacture simple also with respect to the stripper arrangement and to be able to make repairs at a low price if necessary, the stripper arrangement, preferably, comprises individual strippers set spaced apart from each other. Therein, the individual strippers are, preferably, screwed on to allow easy replacement thereof.

An alternative embodiment proposes that the stripper arrangement is formed by stripping prongs going up to the rotor roller and attached to a holding device, said stripping prongs cooperating with the conveying prongs, wherein the surface of the conveying prongs and the surface of the stripping prongs form an angle of, preferably, 90° in relation to each other. This embodiment is, in particular, to advantage in that, as seen in its circumferential direction, the rotor roller has a particularly large working range and seizes and conveys the pressing product to be conveyed in a particularly aggressive and, therefore, particularly effective manner. In addition, the stripper arrangement can be mounted in an advantageously easy manner if it is provided in the form of the stripping prongs.

In order to be able to adjust the loading device to different pressing products having different properties, the invention particularly proposes that the guiding surface and the rotor roller can be spaced apart from each other in a variable manner. To achieve this, the guiding surface or the rotor roller can each be adjustably supported in an appropriate guide; it is also possible that both the guiding surface as well as the rotor roller can each be adjustably supported in a guide. Instead of attaching the bearing points of the rotor roller to a press frame in a stationary manner, it is, for example, possible to arrange said bearing points across a predefinable range, either vertically adjustable or vertically pivotable, with the result that, hereby, the distance between the rotor roller and the guiding surface can be increased or reduced.

In a further embodiment, it is, therein, provided that a maximum distance between the guiding surface and the rotor roller is such that the conveying prongs of the rotor roller just immerse in the slots. Therefore, a safe conveyance of the pressing product by means of the rotor roller and its conveying prongs is still ensured even if the distance is the largest one adjustable and disturbances in the conveyance of pressing product are prevented.

In contrast, it is provided that a minimum distance between the guiding surface on the one hand and the rotor roller or a jacket tube of the rotor roller on the other hand approaches zero in a pressing-chamber-sided pressing product discharge region. This creates the possibility of preventing a conveyance of pressing product from the feeding space into the pressing chamber by adjusting the minimum distance, particularly if the maximum filling of the pressing chamber is reached. Even if the rotor roller continues rotating, the minimum distance that approaches zero also prevents any further conveyance of pressing product from the feeding space into the pressing chamber while the still rotating rotor roller simultaneously transports the residual pressing product still present in its engagement region into the pressing chamber. After a certain run-on time of the rotor roller has elapsed after the minimum distance between the rotor roller and the guiding surface has been adjusted, the working range of the rotor roller is, therefore, free from any pressing product. In particular, it is then no longer possible that pressing product projects from the engagement region of the rotor roller into the pressing chamber. As a result, the pressing shield does not have to cut or clip off any pressing product in the vicinity of the loading opening during its pressing stroke, which would cause a load of the press which would be undesirably high and would be harmful in the long run. In this manner, it is also possible to achieve a maximum precompaction of the pressing product. Therein, it has turned out to be to advantage if the loading device is configured such that, if the minimum distance is adjusted, the strippers surrounding a cylindrical jacket tube of the rotor roller are directly resting upon the guiding surface. Since the guiding surface is slotted in the range of the movement of the conveying prongs, the conveying prongs can pierce through the guiding surface in a downward direction.

In order to be able to adjust the stripper arrangement as necessary or readjust it in case of wear, it is provided that the stripper arrangement can be spaced apart from the guiding surface and/or from the rotor roller in a variable manner.

If it is intended to also shred the pressing product in the loading device in addition to conveyance and precompaction thereof, stationary knives in cutting cooperation with the conveying prongs can be disposed at the guiding surface and/or at the stripper arrangement, said knives allowing cutting the pressing product open or up.

In order to increase the above-mentioned cutting effect, at least a part of the conveying prongs can be formed as knives, or knives can be provided on the rotor roller in addition to the conveying prongs, said knives cooperating with the stationary knives.

In order to be able to terminate the feeding of pressing product into the pressing chamber in a defined manner irrespective of whether or not pressing product is still present in the feeding space, a retaining element is provided according to the invention, which can be moved between a disabling position separating the feeding space from the pressing product reception region of the rotor roller and an enabling position connecting the feeding space to the pressing product reception region of the rotor roller. In the disabling position, any further supply of pressing product to the rotor shaft is prevented, with the result that the rotor roller can completely convey the pressing product still present in its reception region and working range into the pressing chamber before the rotation of the rotor roller is switched off. In this manner, it is not possible that parts of the pressing product remain in the loading opening and project into the pressing chamber, which would disturb the pressing operation of the press.

In a practical embodiment, the retaining element is, preferably, a retaining plate or a retaining grating or a retaining comb and can be slid or swiveled or turned towards in front of the rotor roller.

To move the retaining element, it is, appropriately, provided with a mechanical drive, e.g. with a hydraulic cylinder.

The press as such can have different designs; preferably, it is a baling press or a briquetting press or part of a press container.

Apart from the press illustrated above, the invention relates to a device for processing good pieces. The device according to the invention is characterized in that it comprises features of the loading device, and that it is designed as a device which can be used independently of a press and which is provided for processing good pieces, in particular for opening and emptying good pieces in the form of compressible and/or cuttable filled trading units, such as plastic bottles or cups, or for shredding and/or prepressing miscellaneous residual or recyclable materials. In other words, this device represents a loading device which is, by itself, used as a machine, wherein said loading device is to advantage in that it can be used, for example, for the applications mentioned in this paragraph or also for other applications without any allocated press. The only difference then is that the device is now set up and used by itself instead of in combination with a press. Therein, the technical design can be practically the same in either case, this resulting in favorable manufacturing costs.

For a further development of the aforementioned invention, it is provided that a product carrying duct, e.g. an appropriately dimensioned and conducted pipe, is disposed downstream of a product discharge side of the rotor roller, wherein the product can be supplied to a collecting or transport container through said product carrying duct.

If this device is intended to be used for opening and emptying cuttable filled trading units, a collecting tray is, appropriately, disposed below the rotor roller, preferably with a discharge tube or collecting container connected thereto, wherein free-flowing materials, in particular liquids, which exit or flow out while the filled trading units are opened, can be collected in the collecting tray.

BRIEF DESCRIPTION OF THE DRAWINGS

Exemplary embodiments of the invention will be illustrated below by means of a drawing. In the drawing.

BRIEF DESCRIPTION OF THE DRAWINGS

Figure 1:
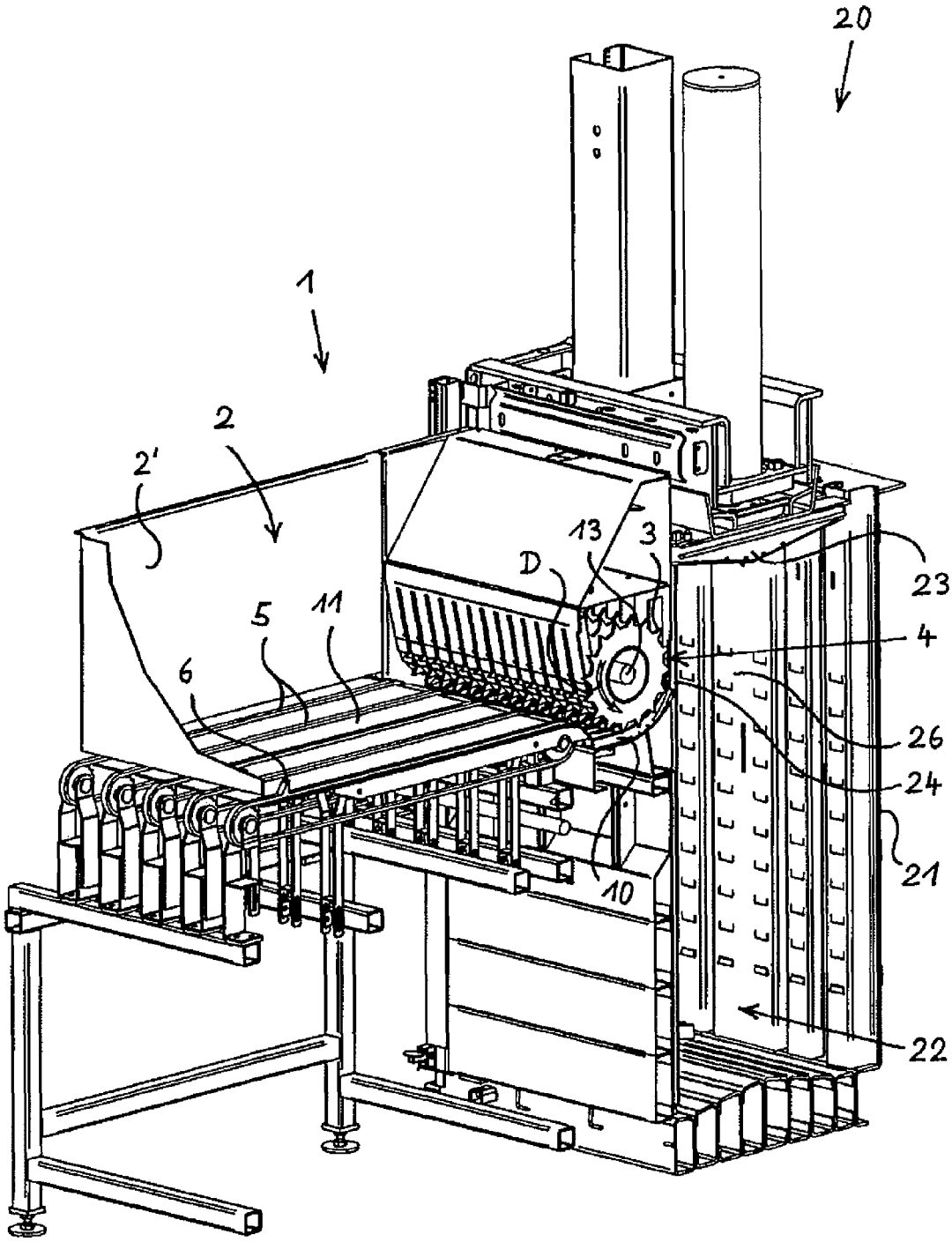
FIG. 1 is a vertical sectional overall view of a press having a loading device with an upstream conveying device.

FIG. 1 shows a vertical baling press 20 having an upstream loading device 1. Pressing product which is to be compacted and comes in the form of pressing product pieces, such as empty cardboard boxes or the like, are fed into a feeding space 2 that is limited by lateral walls 2'. A conveying device 5 which conveys the fed pressing product pieces towards a rotor roller 4 equipped with conveying prongs 3 is provided on the floor 11 of this feeding space 2. The conveying device 5 of the feeding space 2 can be driven and switched on and off by a mechanical drive which can be configured as a hydraulic or electric motor and cooperates with a gear unit if necessary, and/or is designed such that its capacity can be adjusted by means of said mechanical drive. The switching on and off or adjusting of the capacity can be achieved independently; preferably, however, the switching on and off or capacity adjustment of the conveying device 5 of the feeding space 2 is achieved in relation to the torque or current consumption of a mechanical drive driving the rotor roller 4.

In the example shown in FIG. 1, the conveying device 5 comprises circumferential conveyor chains which can, in turn, be additionally equipped with carrier tools either completely or partially, e.g. with the prongs 6 indicated at a point in FIG. 1. These conveyor chains and the carrier tools attached thereon seize the fed pressing product pieces. During operation of the conveying device 5, these pressing product pieces are conveyed towards the rotor roller 4 equipped with the conveying prongs 3. As soon as the pressing product pieces enter the motion range of the conveying prongs 3 of the rotor roller 4, they are seized by the conveying prongs and carried in the direction of rotation D of the rotor roller 4.

Once the conveying prongs 3 have seized the pressing product, they carry it along in conveying direction. The rotor roller 4 is driven by means of a mechanical drive, such as a hydraulic motor, which in turn drives a reduction gear unit which is connected to a central shaft 13 of the rotor roller 4 in a positive locking manner. Instead of being driven hydraulically, the rotor roller 4 can also be driven by means of an electric gear motor.

The rotor roller 4 conveys the pressing product to be pressed through a gap space between the outer rotor roller circumference and a guiding surface 10 positioned below the rotor roller 4 and through a loading opening 24 into a feeding region 26 of the press 20. As long as a small quantity of pressing product has been fed, the pressing product falls out of the feeding region 26 in a downward direction, thus gradually filling the pressing chamber 22 of the press 20. Once the pressing chamber 22 is filled, the rotor roller 4 is stopped and further pressing product is no longer supplied, and a pressing operation is performed. To achieve this, a pressing shield 23 is moved down from its resting position which is the upper one in FIG. 1 by means of a mechanical drive, wherein the pressing product is compacted in the pressing chamber 22. After the pressing shield has moved back, further pressing product can be conveyed into the pressing chamber 22 by means of the rotor roller 4, whereupon another pressing operation is performed. This procedure is repeated until a pressed bale of the desired size is obtained. The pressed bale produced in the baling press 20 from the pressing product supplied is then tied and finally removed from the baling press 20.

Figure 2:
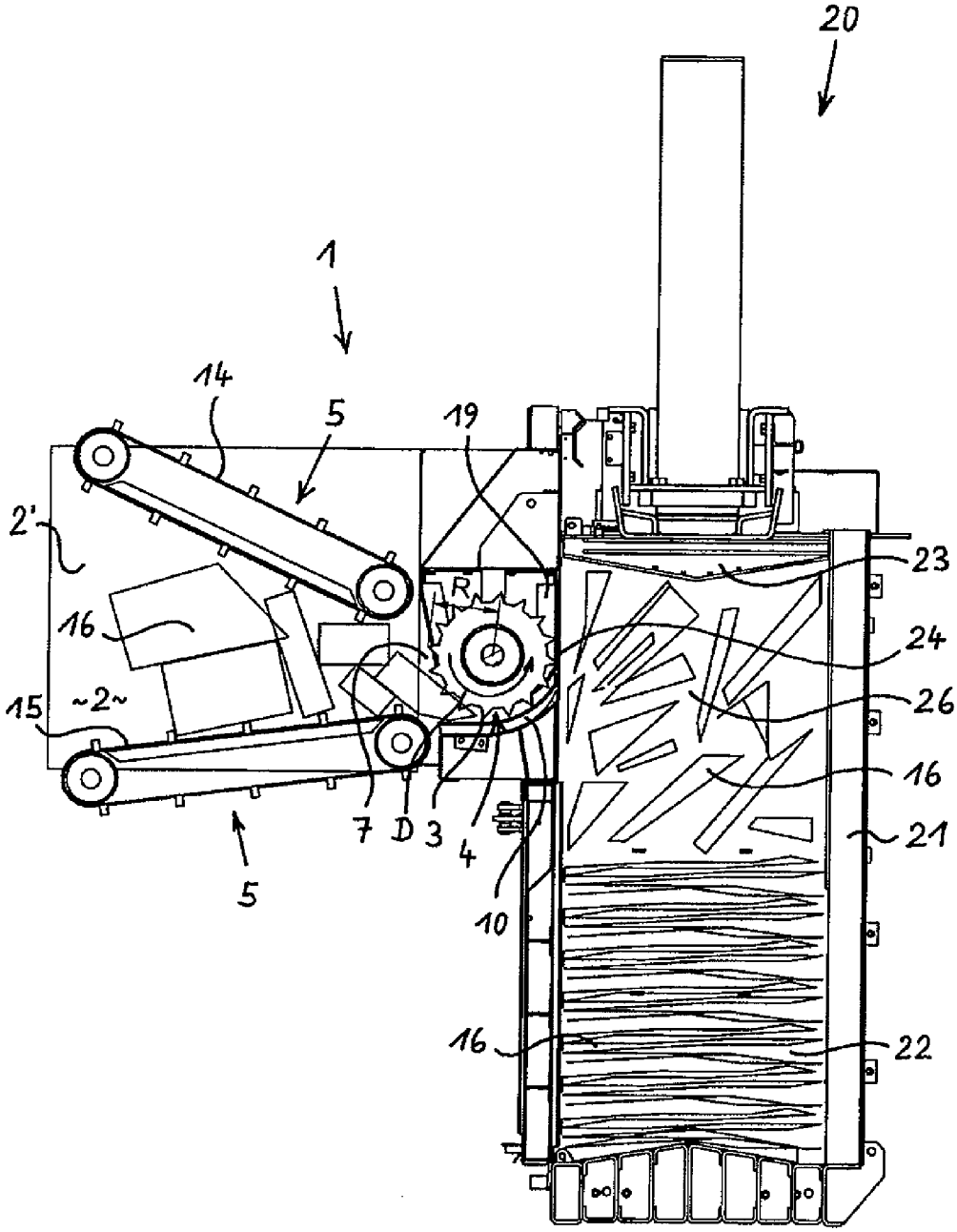
FIG. 2 is a vertical sectional view of the press having the loading device with an alternative conveying device.

FIG. 2 again shows the press 20 having a loading device 1, however now having an alternative conveying device 5 in the feeding space 2. This alternative conveying device 5 comprises two conveyor belts 14 and 15. Here, the pressing product pieces 16 to be pressed are placed onto the lower conveyor belt 15. If the pressing product pieces are flat ones, they are directly supplied to the pressing product reception region 7 of the rotor roller 4, seized by the conveying prongs 3 thereof and conveyed into the feeding region 26 of the baling press 20.

Pressing product pieces with a larger spatial extension, such as big cardboard boxes, are seized by the upper conveyor belt 14 which is attached above the lower conveyor belt 15 and is running towards the lower conveyor belt 15 at any angle desired, however, preferably at an acute angle, and are then conveyed through the narrowest point between the two conveyor belts 14, 15. Therein, large cardboard boxes are also flattened and are, thus, better suitable for being received by the conveying prongs 3 of the rotor roller 4.

Other conveying means, e.g. screw rollers or scraper-chain conveyors, which are, however, not shown separately here, are also conceivable instead of the conveyor belts 14, 15.

Figure 3A:
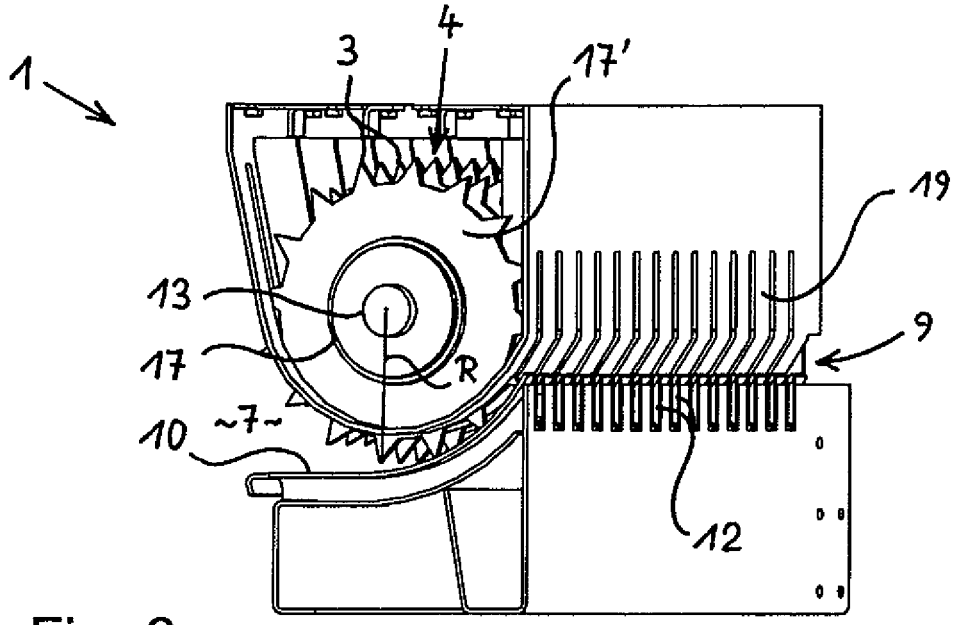
FIG. 3*a* is a first view of the loading device shown in FIG. 1 and FIG. 2 as such.
Figure 3B:
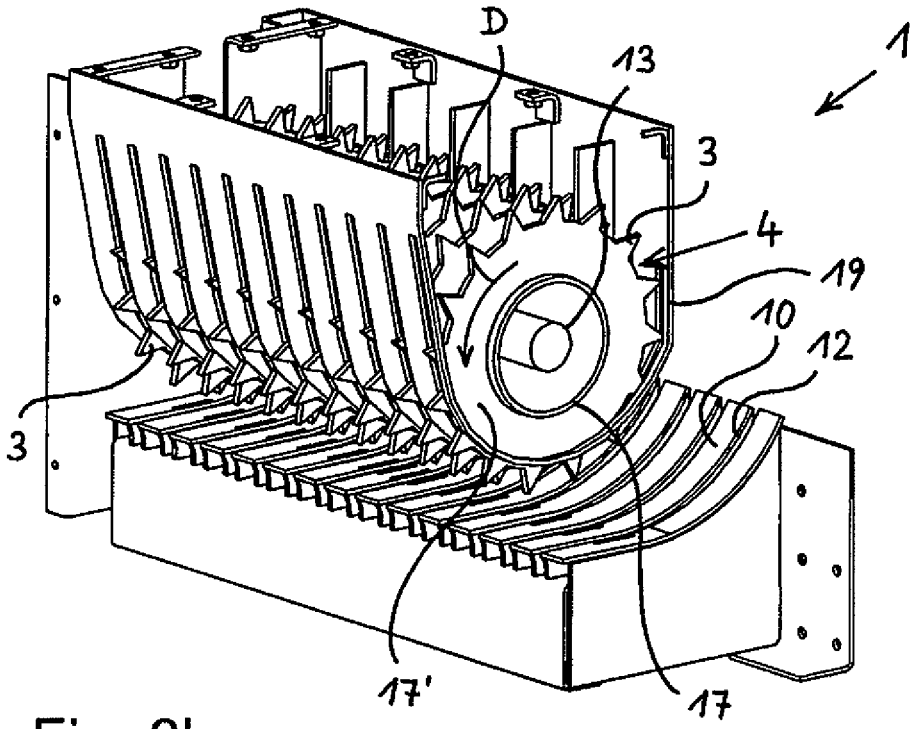
FIG. 3*b* is a second view of the loading device shown in FIG. 1 and FIG. 2 as such.

FIGS. 3*a* and 3*b* each show the loading device 1 in an enlarged view. The central element thereof is formed by the rotor roller 4 which comprises the central shaft 13 and the jacket tube 17 being concentric therewith and which is provided with bearing pins on either side, said bearing pins not being visible here. On its outer circumference, the jacket tube 17 is equipped with the disks 17' having the conveying prongs 3. In the illustrated instance, these conveying prongs 3 are formed at the radially outer contours of the disks 17' which are welded onto the jacket tube 17.

The rotor roller 4, in turn, runs inside a cage which is formed by a stripper arrangement 19. In the illustrated instance, the stripper arrangement 19 is formed from individual strip-like strippers which are disposed next to and spaced apart from each other. In the pressing product reception region 7, the outer radius R of motion of the prongs 3 extends outside of the stripper arrangement 19, i.e. in the illustrated instance, the conveying prongs 3 project from this stripper arrangement in an outward direction and seize the pressing product.

In the pressing product discharge region 9, the stripper arrangement 19 is formed such that the outer radius R of motion of the prongs 3 extends into the inner region of the cage. In the pressing product discharge region 9 which is positioned in the loading opening of the press, the stripper arrangement 19 strips off the pressing product from the conveying prongs 3.

Figure 4A:
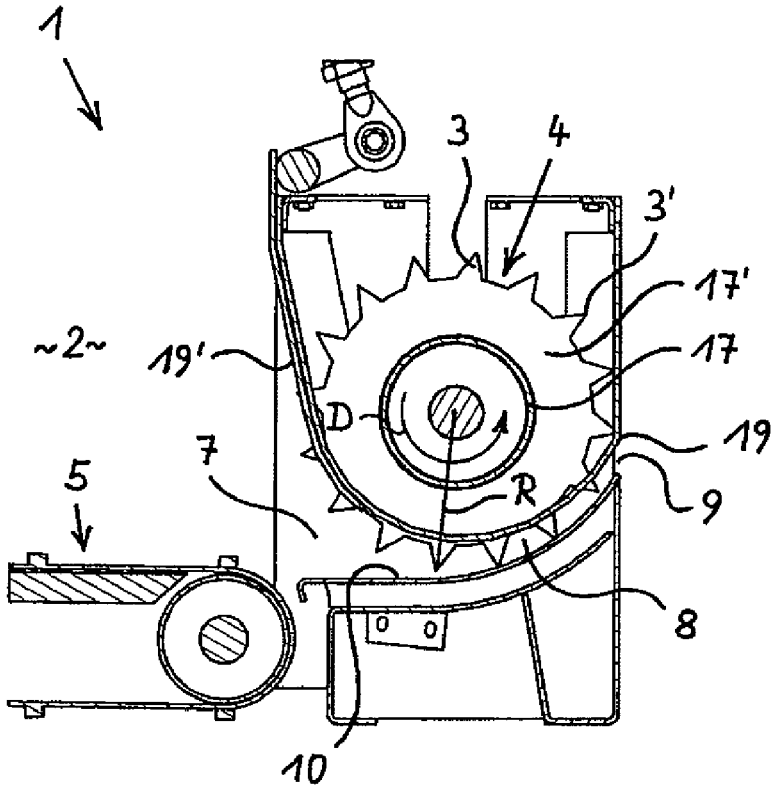
FIG. 4*a* is a cross-sectional view of the loading device shown in FIG. 1 and FIG. 2 as such, in a first operating state.
Figure 4B:
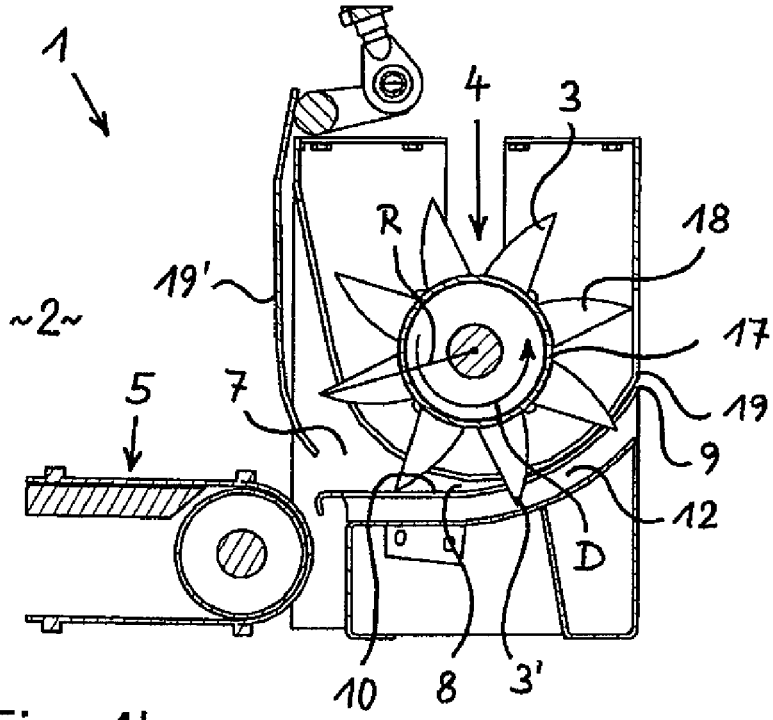
FIG. 4*b* is a view of the loading device in a modified embodiment, in the same representation as in FIG. 4*a;*

FIGS. 4*a* and 4*b* each show a sectional view of two different embodiments of the loading device 1.

As is indicated by the appropriate reference symbols in FIG. 4*a*, the region in which the pressing product is conveyed further through the rotor roller 4 can be functionally divided into a conveying channel 8 and a pressing product discharge region 9. In the pressing product reception region 7, the conveying prongs 3 initially press the pressing product towards a guiding surface 10, e.g. a guiding plate, which is disposed below the rotor roller 4. In this region, the pressing product is clamped between the between the conveying prongs 3 and the guiding surface 10 and taken along in conveying direction. The conveying prongs 3 are each provided with an acute tip 3' so that they can be better pressed into the pressing product to be pressed.

In the pressing product reception region 7, the guiding surface 10 is disposed immediately adjacent to the floor of the feeding space 2, said floor being equipped with the conveying device 5. In order to prevent the pressing product from accumulating, the guiding surface 10 is positioned at a somewhat deeper level than the surface of the conveying device 5 of the feeding space 2. While, in the pressing product reception region 7, the guiding surface 10 still comprises a contour that deviates from the radius R delineated by the tips of the prongs 3, the radius of the guiding surface 10 initially approaches the radius R of motion of the tips of the prongs in the further course of the conveying channel 8. In the further course of the conveying channel, particularly in the pressing product discharge region 9, however, the radius of the guiding surface 10 becomes smaller than the radius R of motion of the tips of the prongs 3.

In the region where the radius R of motion of the tips of the prongs 3 is in excess of the radius of the guiding surface 10, the guiding surface 10 is provided with slots 12 in which the prongs 3 can immerse.

In FIG. 4*a*, the conveying prongs 3 are formed on the radially outer edge of disks 17' which are welded onto a jacket tube 17 of the rotor roller 4. As an alternative, it is also conceivable according to FIG. 4*b* that the conveying prongs 3 are formed as individual prong components 18 which are welded onto the jacket tube 17.

In addition, FIG. 4*b* shows how the prongs 3 can immerse with their tips in slots 12 of the guiding surface 10, said slots 12 each being allocated to said tips. It can also be seen how the tips of the prongs 3 withdraw from the stripper arrangement 19 whereby the pressing product 16 taken along by said tips of the prongs 3 is stripped off.

Furthermore, FIGS. 4*a* and 4*b* illustrate that, in the illustrated instance, the rotor roller 4 is mounted together with the stripper arrangement 19 such that they can be moved in vertical direction. In FIG. 4*a*, the rotor roller 4 assumes a position in which it is moved up and in which the prongs 3 are just reaching the guiding surface 10. In FIG. 4*b*, the rotor roller 4 is lowered as far as possible. In this position, the stripper arrangement 19 abuts against the guiding surface 10 and the conveying channel 8 is, therefore, closed. Now, any further conveyance of pressing product into the conveying channel 8 is no longer possible; however, pressing product that has already been present in the conveying channel 8 beforehand can still be conveyed to the pressing product discharge region 9. This ensures that no pressing product projects from the loading device 1 and into the pressing chamber of the press during a pressing operation. This prevents an unfavorably high load of the press which would develop if pressing product was clipped off.

Finally, FIGS. 4*a* and 4*b* show a retaining element 19' which can be moved between an enabling position according to FIG. 4*a* and a retaining or disabling position according to FIG. 4*b*. To achieve this, the retaining element 19' is designed as a plate in the illustrated instance and mounted such that it can be swiveled about its upper edge. In its enabling position, the retaining element 19' is swiveled towards the rotor roller 4 and allows free access of the pressing product into the pressing product reception region 7. In its disabling position, the retaining element 19' points down in an approximately vertical direction and prevents pressing product from entering the pressing product reception region 7. In its lower region, the retaining element 19' is slotted like a comb in order to prevent it from colliding with the conveying prongs 3 in its enabling position.

Figure 5:
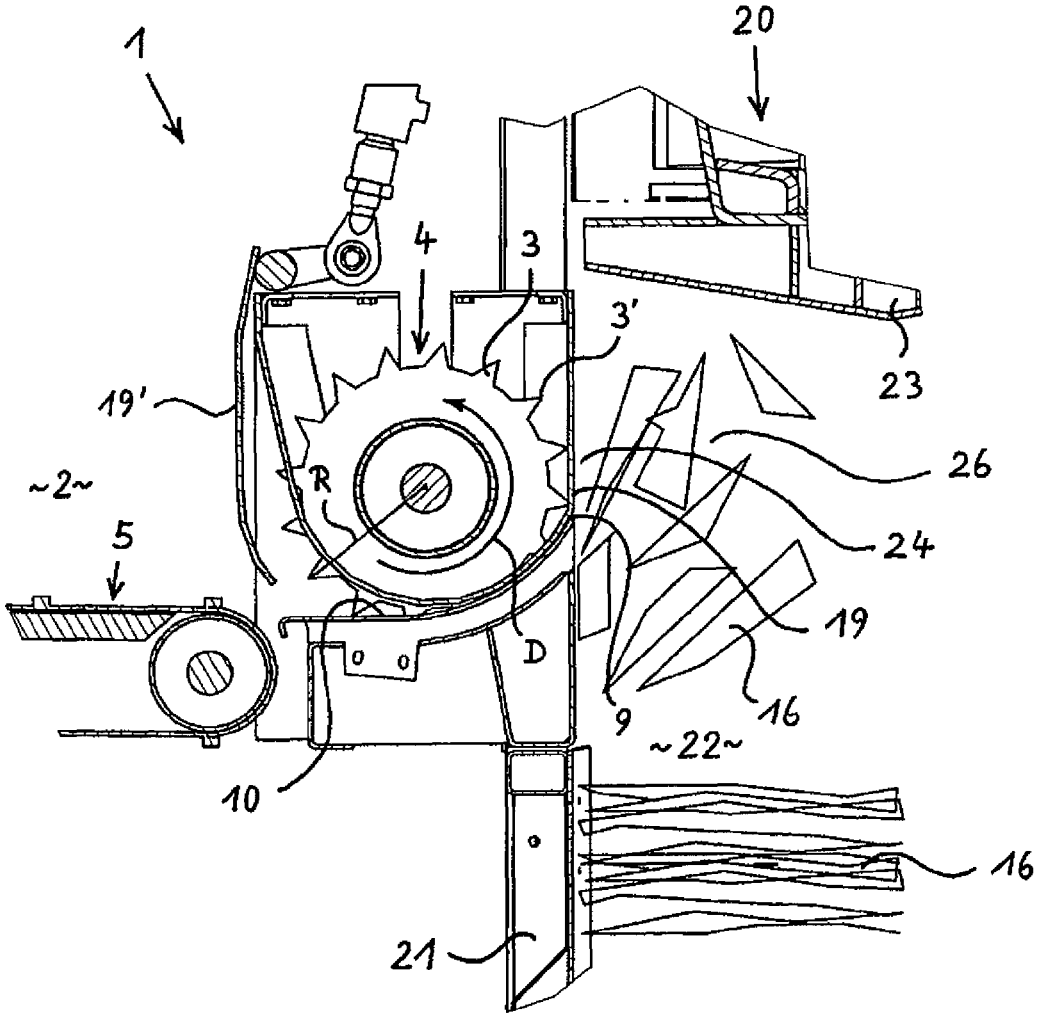
FIG. 5 is a cross-sectional view of the loading device shown in FIG. 4*a*, in a second operating state.

FIG. 5 illustrates a structural feature of the loading device 1, which comprises that the distance between the tips 3' of the conveying prongs 3 and the guiding surface 10 can be reduced such that the prong tips 3' completely immerse in the guiding surface 10.

Towards the end of a filling operation, i.e. when the rotor roller has to press the pressing product 16 into the feeding region 26 of the baling press 20, the torque of the mechanical drive of the rotor roller 4 increases. Appropriately, a control of the baling press 20 is configured such that it registers this fact and then switches off the conveying device 5 of the feeding space 2. In order to now completely interrupt the supply of pressing product to the rotor roller 4, the retaining element 19' which is positioned upstream of the rotor roller 4 as seen in conveying direction is swiveled out towards the feeding space 2 by means of an allocated mechanical drive.

The retaining element 19' is folded out such that it is positioned outside of the radius R of motion delineated by the outermost prong tips 3' during their rotary motion. In this case, the retaining element 19' projects such that the prongs 3 of the rotor roller 4 can no longer come into engagement with pressing product positioned in front of the retaining element 19', i.e. to the left thereof according to FIG. 5.

After the retaining element 19' has been swiveled out, the rotor roller 4 is now moved by appropriate means, e.g. by a hydraulic cylinder which is not shown here, to a lower position along with the stripper arrangement 19 surrounding it, said lower position shown in FIG. 5. In this lower position, the stripper arrangement 19 rests on the guiding surface 10 at least in the pressing product discharge region 9; hereby, the loading device 1 is completely closed. Since the distance between the guiding surface 10 and the stripper arrangement 19 now becomes minimal, pressing product 16 is not conveyed any longer. A few rotations of the rotor roller 4 now only cause residual pressing product 16 still present in the conveying channel 8 to be conveyed out of the conveying channel 8 and into the feeding region 26 of the press 20.

To perform the pressing of the pressing product 16 in the baling press 20 following in the next step, it is, therefore, advantageously achieved that pressing product 16 no longer projects from the loading device 1 and into the feeding region 26 of the baling press 20. Any disturbances of the pressing operation caused thereby as well as any undesired high mechanical load of the moving parts of the baling press 20 are, thus, avoided.

Figure 6:
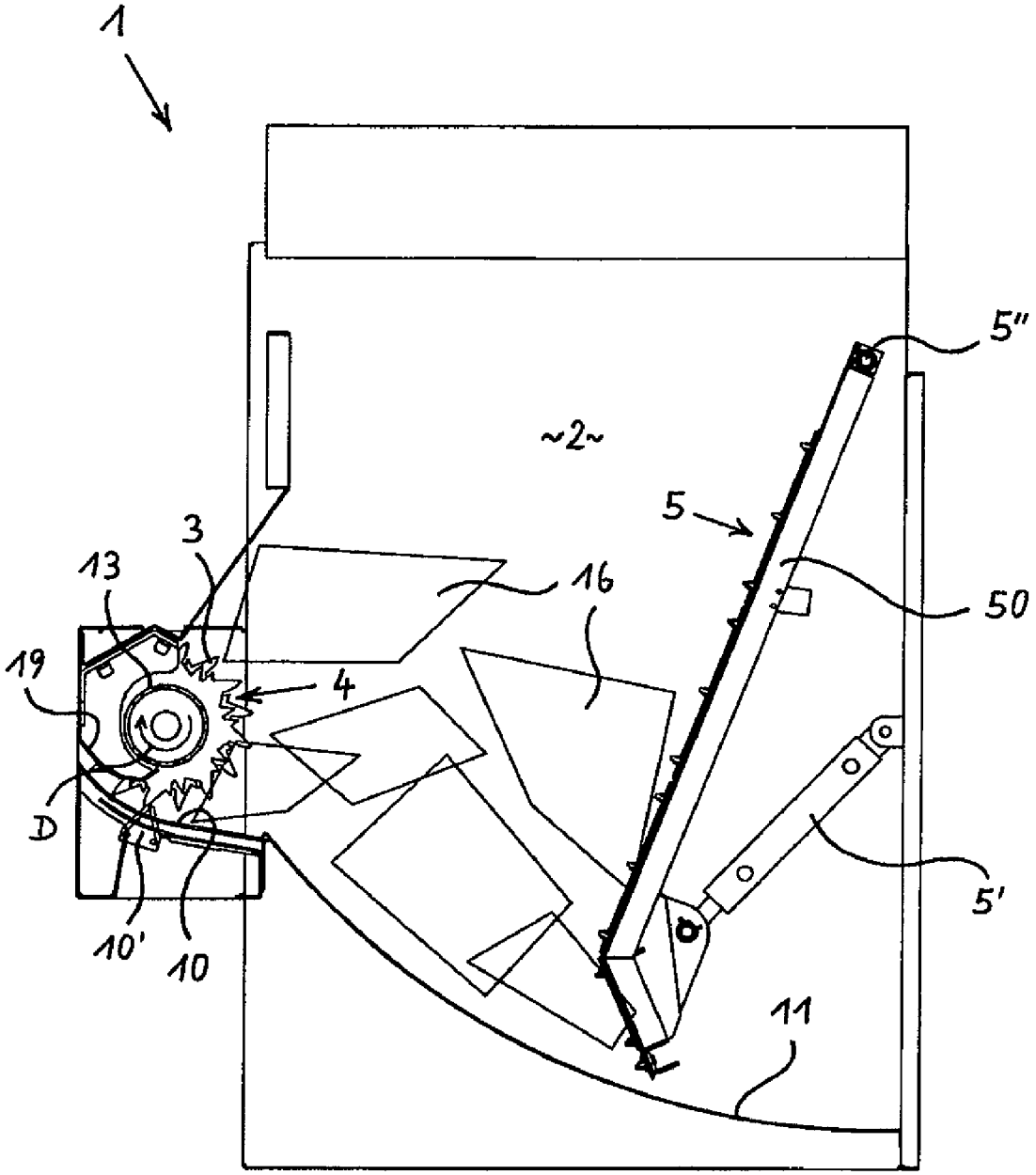
FIG. 6 is a vertical sectional view of the loading device with an upstream conveying device in a modified embodiment, in a first operating state.
Figure 7:
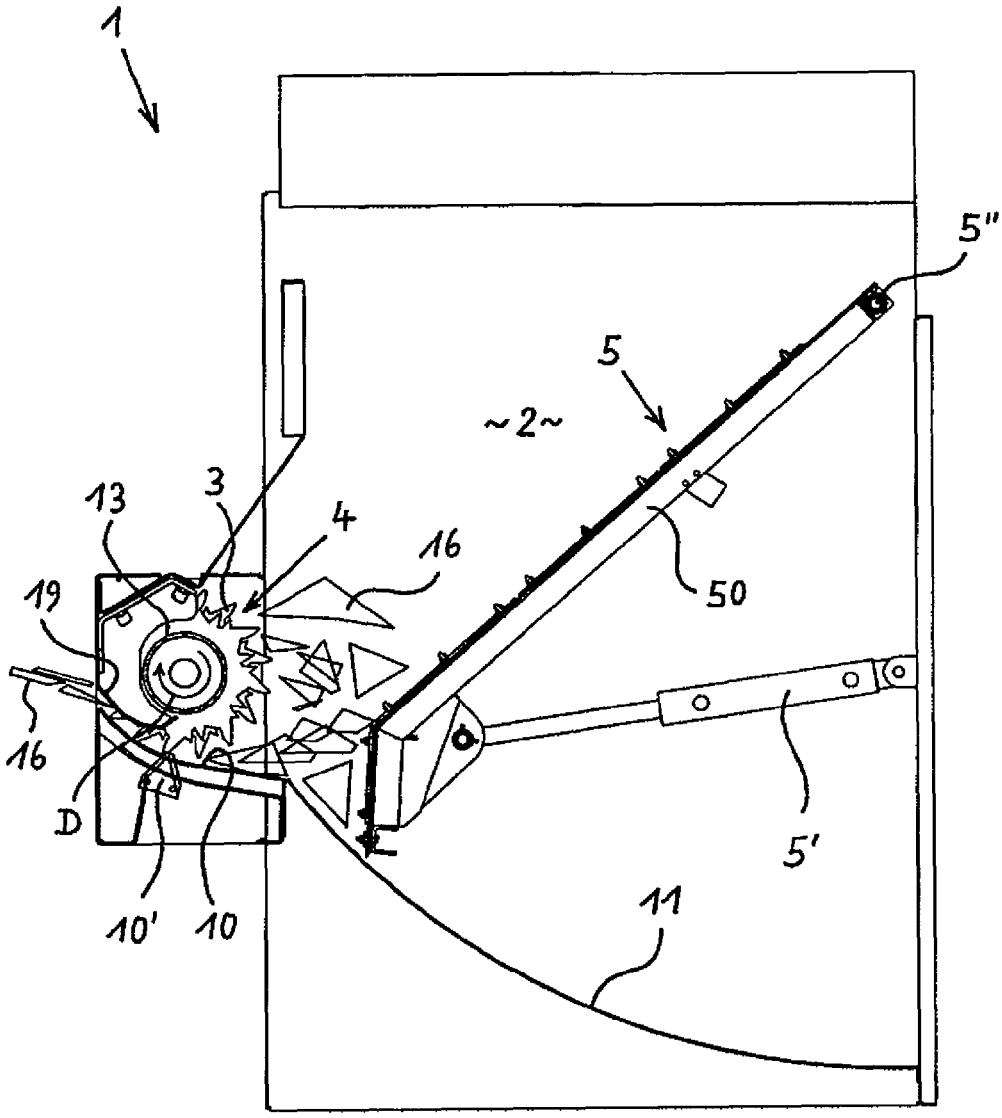
FIG. 7 is a vertical sectional view of the loading device with an upstream conveying device shown in FIG. 6, in a second operating state.

FIGS. 6 and 7 each show a cross-sectional view of another embodiment of the loading device 1 in two operating states. Here as well, the loading device 1 comprises a feeding space 2 which is open at its top and has a conveying device 5 disposed therein, said conveying device 5 here being designed as a swiveling conveying shield 50 having a mechanical drive 5' in the form of a hydraulic cylinder. The floor 11 of the feeding space 2 has the shape of a horizontal cylinder jacket section whose horizontal central axis coincides with the swivel axis 5" of the conveying shield 50. In FIG. 6, the conveying shield 50 is swiveled back, thus clearing the feeding space 2 so that said feeding space 2 can be loaded with the pressing product 16 by placing or throwing it therein from above.

The rotor roller 4 with the conveying prongs 3, the guiding surface 10 and the stripper arrangement 19 can be seen to the left in FIGS. 6 and 7. In the illustrated instance, the stripper arrangement 19 is formed by stripping prongs which are approaching the rotor roller 4, are attached to a holding device, project between the conveying prongs 3 and cooperate with the conveying prongs 3, wherein the surface of the conveying prongs 3 and the surface of the stripping prongs form an angle in relation to each other, which is preferably 90°. The press which is not shown here is disposed adjacent thereto to the left.

In the state shown in FIG. 7, the conveying shield 50 is swiveled towards the rotor roller 4 by means of the mechanical drive 5'. This swivel motion causes the pressing product 16 in the feeding space 2 to be supplied to the rotor roller 4 in a compulsory manner, so that it can be reliably seized and conveyed into the press by the conveying prongs 3.

As illustrated in FIGS. 6 and 7, the prongs 3 are here exposed in the entire circumferential region of the rotor roller 4, said circumferential region facing the feeding space 2, with the result that it is ensured that the prongs 3 grip the pressing product 16 in an aggressive manner. The stripper arrangement 19 is positioned on the side of the rotor roller 4 facing away from the feeding space 2 and ensures that the pressing product 16 is reliably detached from the conveying prongs 3 and transferred into the pressing space of the press.

In addition, FIGS. 6 and 7 still show stationary knives 10' which are, herein, connected, e.g. screwed, to the guiding surface 10 and are in cutting cooperation with the conveying prongs 3. As a result, the pressing product 16 can not only be conveyed and prepressed in the loading device 1 but can also be cut open and/or up if this further function is required or desired. If this function is not required, the knives 10' can be omitted or dismounted from the very beginning.

Figure 8:
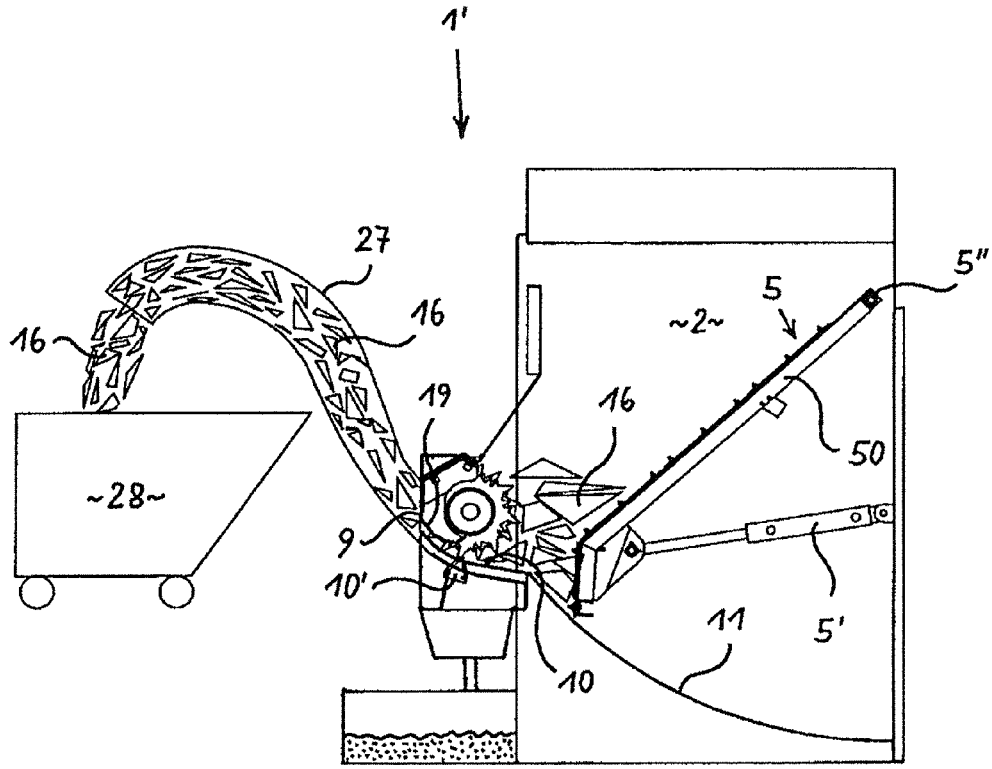
FIG. 8 is a vertical sectional view of the loading device with an upstream conveying device in an embodiment as a device that can be used by itself.

FIG. 8 shows the loading device 1 in an embodiment and application as a device 1' that can be used by itself without any allocated press. In the illustrated instance, the device 1', therein, serves to reduce and/or empty and/or prepress pressing product 16, e.g. filled plastic trading units, such as plastic bottles. The technical details correspond to the loading device 1 according to FIGS. 6 and 7, and reference is made to the description thereof.

In the illustrated instance, a pressing product channel 27 in the form of a curved tube is disposed downstream of the pressing product discharge region 9, wherein the pressing product 16 that has been reduced and/or emptied and/or prepressed can be supplied through said pressing product channel 27 and to a collecting or transport container 28, e.g. a cart with wheels indicated in FIG. 8 of the drawing.

Figure 9:
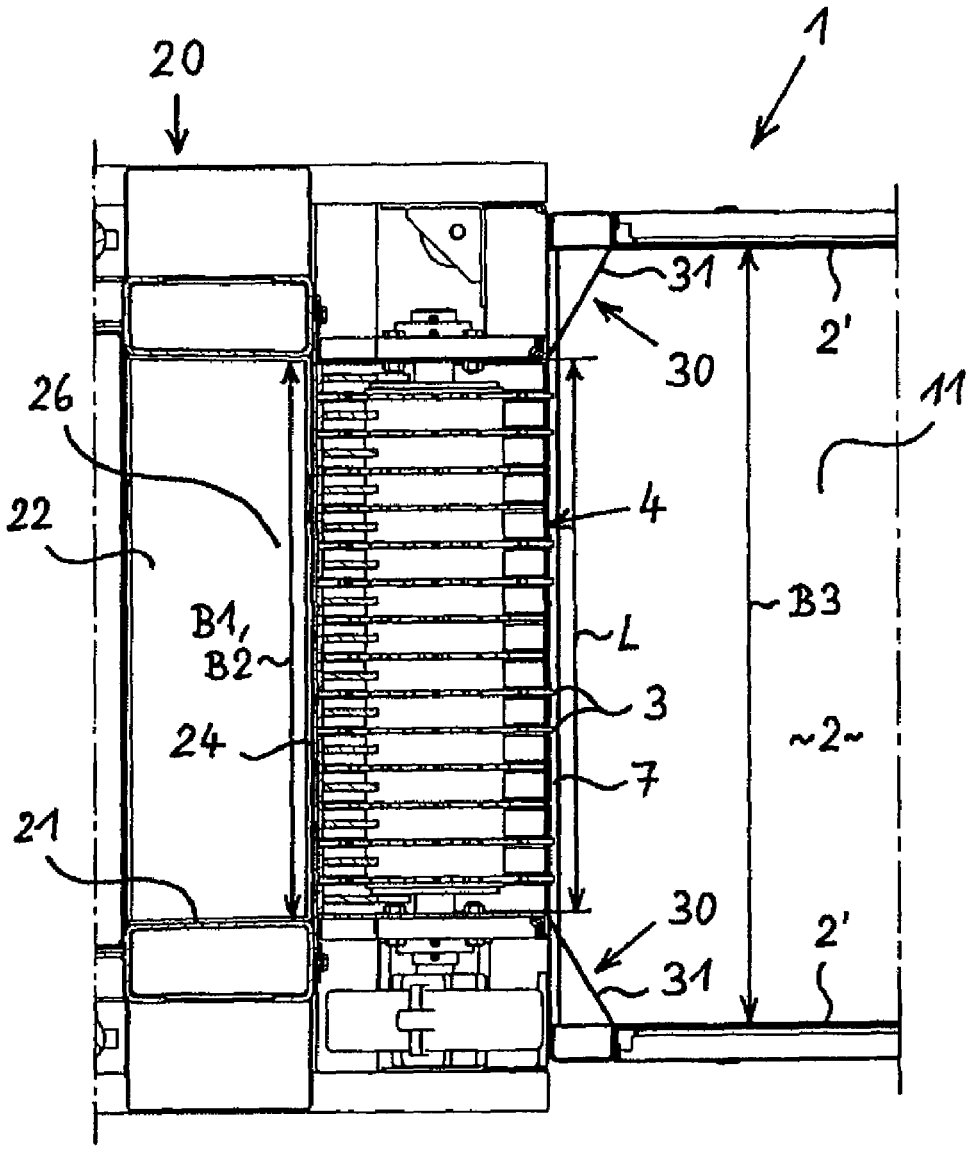
FIG. 9 is a horizontal view of a press having a loading device and a feeding space in a further embodiment, at the level of the loading device.
Figure 10:
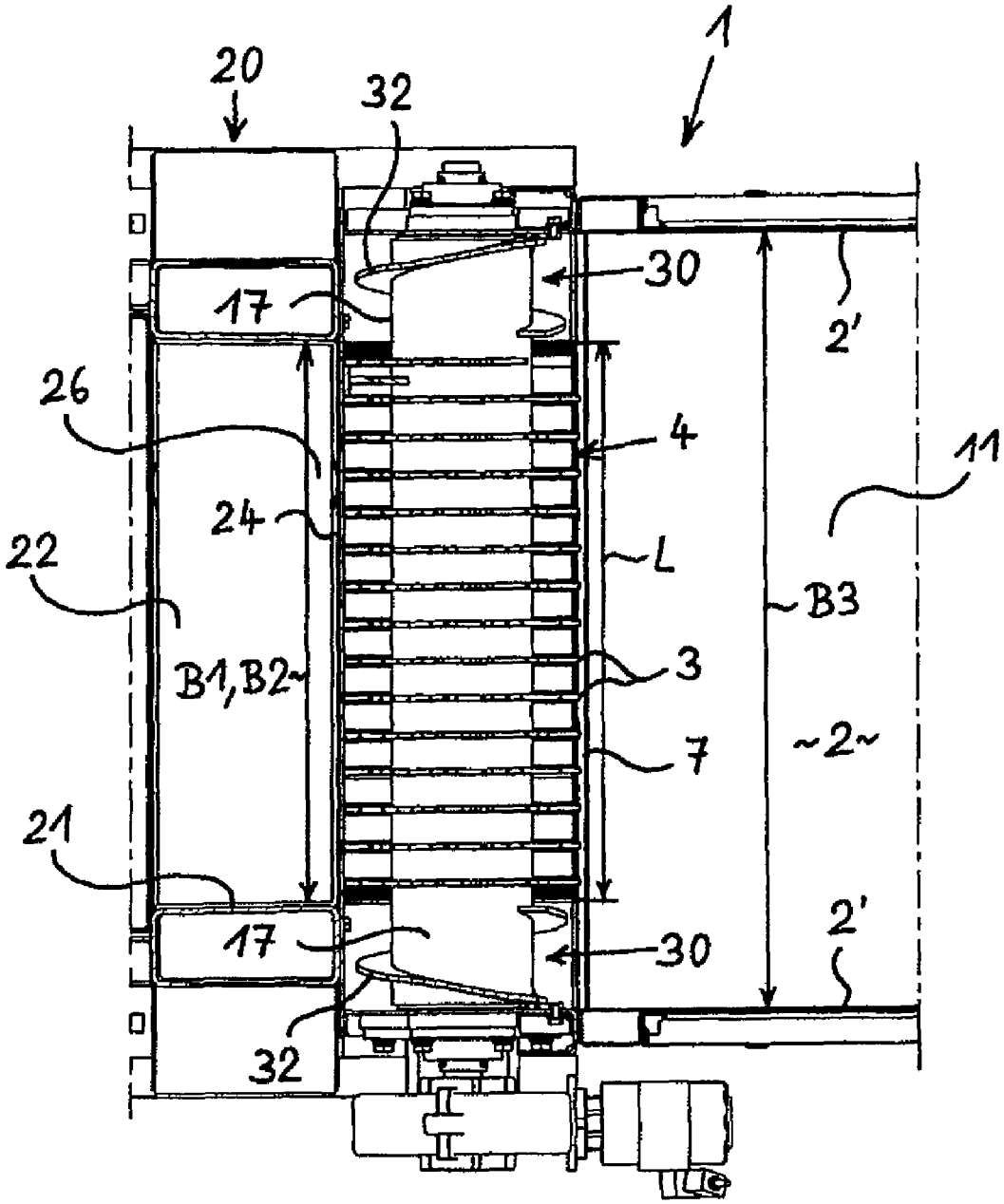
FIG. 10 is a view of the press having a loading device and a feeding space in a further embodiment, in the same representation as in FIG. 9.

FIGS. 9 and 10 show an embodiment of the loading device 1 which, in particular, allows achieving a high pressing product density in the lateral regions of the pressing chamber 22 of the associated press 20, wherein the lateral regions of the pressing chamber 22 are positioned at the top and bottom in the sectional view of FIGS. 9 and 10.

A feeding space 2 which is laterally limited by two lateral walls 2' can be seen to the right in FIG. 9. At its bottom, the feeding space 2 is terminated by a floor 11. A conveying device which is not visible here is provided in the feeding space 2. By means of this conveying device, pressing product to be pressed and thrown into the feeding space 2 can be conveyed to the rotor roller 4 which is positioned to the left of the feeding space 2, as has already been described above.

On its side facing the feeding space 2, the rotor roller 4 has a pressing product reception region 7 in which the pressing product is seized and conveyed out of the feeding space 2 by conveying prongs 3 attached to the rotor roller 4 during rotation of the latter.

A part of the press 20 can be seen to the left of the rotor roller 4 wherein, in the illustrated instance, the cutting plane of the drawing extends through the pressing chamber 22 of the press 20. The pressing chamber 22 is limited by a press housing 21. The rotor roller 4 inserts the pressing product that has been conveyed out of the feeding space 2 through a loading opening 24 and into a feeding region 26 of the pressing chamber 22 wherein, due to the compulsory conveyance by means of the rotor roller 4, the pressing product is already precompacted while it is conveyed into the feeding region 26 of the pressing chamber 22.

In the exemplary embodiment shown here, the pressing chamber has an inner width B1, as seen in parallel to the rotor roller 4, and the loading opening 24 thereof has a width B2 corresponding thereto. Matching this, the conveying part of the rotor roller 4 that is equipped with the conveying prongs 3 has an axial length L which corresponds to the widths B1 and B2.

Contrary thereto, the feeding space 2 has a width B3 as measured in parallel to the rotor roller 4, which is in excess of the length L and the widths B1 and B2 corresponding thereto, as is illustratively shown in FIG. 9. In the feeding space 2, a lateral guiding device 30 is provided on each marginal side immediately in front of the rotor roller 4, i.e. immediately to the right of the axial end regions of the rotor roller 4 according to FIG. 9 of the drawing. In the example according to FIG. 9, the two guiding devices 30 in the feeding space 2 are each formed by a guide wall 31 disposed at an angle. These guide walls 31 ensure that the pressing product to be pressed is deflected from the lateral edge regions of the feeding space 2 towards the center while it moves towards the rotor roller 4, said movement being generated by means of the conveying device. Hereby, it is achieved that the pressing product concentrates in the lateral edge regions of the part of the rotor roller 4 that is equipped with conveying prongs 3, this ensuring a high pressing product density of the pressed bale produced in the interior region of the pressing chamber 22 even in the lateral edge regions, i.e. at the top and bottom according to FIG. 9. As seen over its cross-section in parallel to the drawing plane, the pressed bale produced, thus, obtains a uniform pressing density which is, in particular, also high in the lateral end regions.

In the exemplary embodiment according to FIG. 10, the guiding devices 30 are designed as active devices, i.e. here each in the form of a conveyor screw section 32 disposed axially on the end sides of the rotor roller 4. In the illustrated instance, the conveyor screw sections 32 are helical sheet-metal strips which are attached on a jacket tube 17 of the rotor roller 4 and extend in opposite directions. Their thread direction is selected such that, with the rotor roller 4 rotating in conveying direction, the two conveyor screw sections 32 cause pressing product to be conveyed from the lateral edge regions of the feeding space 2 and the rotor roller 4 towards the center. This active guiding device 30 also accomplishes the purpose already described above, i.e. to also achieve a high pressing product density in the lateral edge regions of the pressing chamber 22 and the pressed bale produced therein.

Reference is made to the description of FIG. 9 with regard to the further parts shown in FIG. 10.

Figure 11:
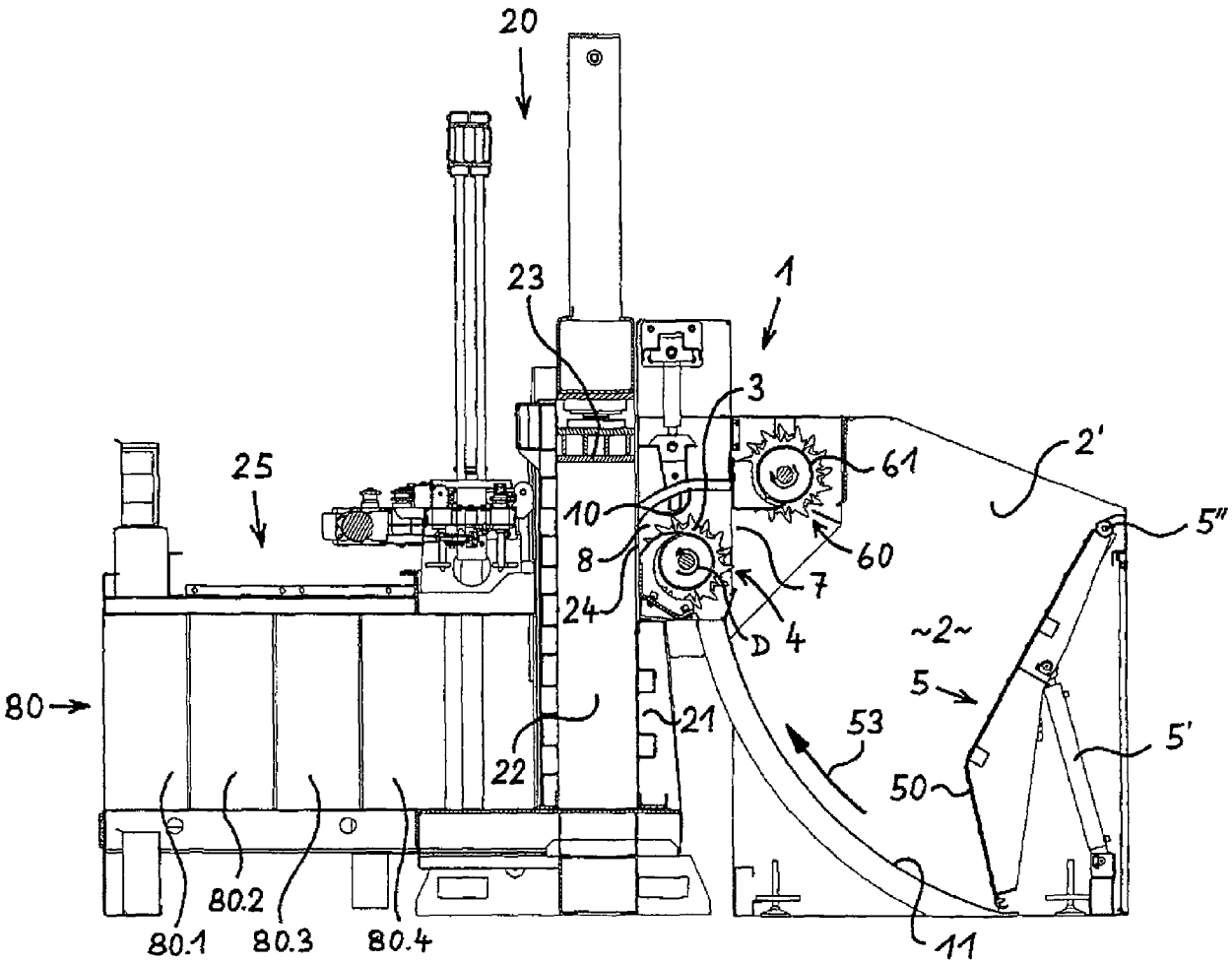
FIG. 11 is a vertical sectional view of the press having a loading device in a further embodiment.

FIG. 11 is a vertical sectional view of a press 20 for pressing pressing product, such as used paper, cardboard, plastic bottles, foils and the like. The press 20 has a press housing 21 comprising a rectangular cross-section. A pressing shield 23 can be moved in vertical direction by means of a mechanical drive in a pressing chamber 22 in the press housing 21, wherein FIG. 11 shows the pressing shield 23 in its upper position at the upper end of the pressing chamber 22. A loading opening 24 through which pressing product to be pressed can be fed into the pressing chamber 22 by means of the loading device 1 is disposed in an upper region of the pressing chamber 22 below the pressing shield 23 in its uppermost position.

In FIG. 11, the loading device 1 is disposed to the right of the press 20. The loading device 1 has a feeding space 2 which is designed in the form of a box with an open upper side, wherein a lateral wall 2' of the feeding space 2 can be recognized in the background of FIG. 11. In the illustrated instance, a floor 11 of the feeding space 2 is curved in the form of a cylinder jacket section. In the illustrated instance, a conveying device 5 disposed in the feeding space 2 comprises a conveying shield 50 which can be swiveled about a horizontal swivel axis 5" extending perpendicularly to the drawing plane by means of a mechanical drive 5'. The swivel axis 5" simultaneously forms the central axis of the floor 11 which extends in a curve. If the mechanical drive 5' is actuated, the conveying shield 50 is swiveled along the floor 11 in clockwise direction, whereby it conveys pressing product inserted into the feeding space 2 towards the press 20 in the sense of the arrow 53.

A rotor roller 4 which is equipped with conveying prongs 3 and can be put into rotation by a drive not visible here is disposed immediately in front of the loading opening 24 of the press 20. A curved guiding surface 10 the distance of which from the rotor roller 4 can be adjusted extends above the rotor roller 4. Together, the rotor roller 4 and the guiding surface 10 form a conveying channel through which the pressing product supplied by the conveying device 5 can be conveyed into the pressing chamber 22 under precompression.

In addition, the loading device 1 has an auxiliary conveying device 60 which is disposed in front of and above the rotor roller 4 as seen in the pressing product conveying direction. In the example according to FIG. 11, the auxiliary conveying device 60 comprises a conveying roller 61 which is disposed in parallel to the rotor roller 4 and is rotatably driveable opposite to the direction of rotation D of the rotor roller 4. The conveying roller 61 ensures that pressing product supplied by the conveying device 5 is reliably transported into a pressing product reception region 7 of the rotor roller 4 without being able of gliding or falling back, so that the pressing product is safely seized by the conveying prongs 3 of the rotor roller 4 there and can be transported into the pressing chamber 22 through the conveying channel 8 and the loading opening 24.

In the pressing chamber 22, the pressing product is pressed to form pressed bales in a manner that is known as such. In the illustrated instance, the pressed bales produced in the press 20 have a relatively small thickness as measured in horizontal direction and in parallel to the drawing plane and, therefore, have the form of a disk, figuratively speaking. A plurality of such partial pressed bales 80.1 to 80.4, a total of four in the illustrated instance, can be collected in a storage space 25 which is disposed downstream of the press 20, i.e. to the left of the press 20 in FIG. 11. In this storage space 25, the partial pressed bales 80.1 to 80.4 can then be tied and, thus, combined to form a larger pressed bale 80 which can then be ejected or pulled out of the storage space 25 to the left and can then be transported away.

Figure 12:
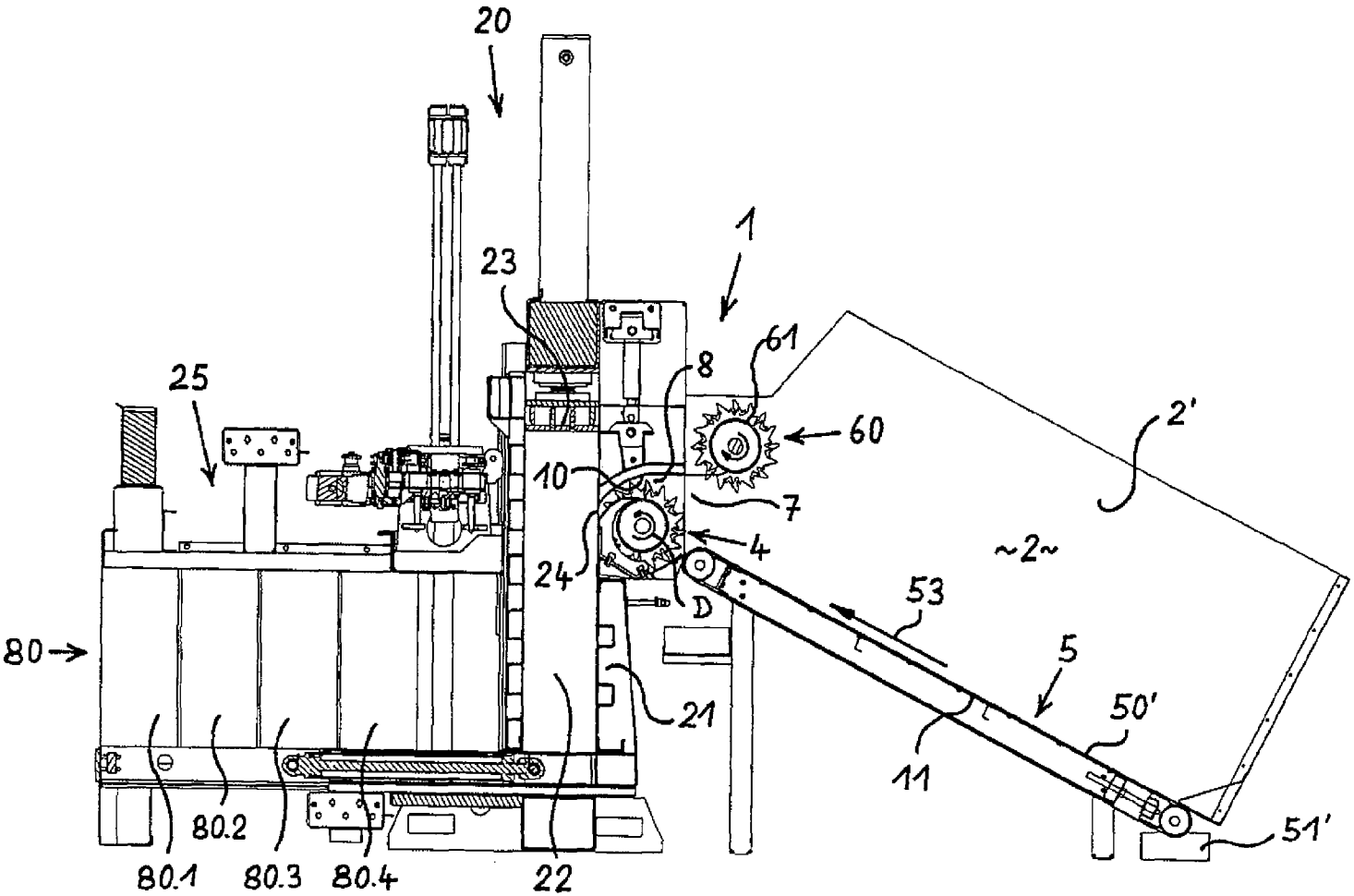
FIG. 12 is a vertical sectional view of the press having a loading device in a further embodiment.

In the exemplary embodiment according to FIG. 12, the press 20 having the feeding space 25 is designed in correspondence with the example according to FIG. 11, for which reason reference is made to the description of FIG. 11 in this regard.

As compared with FIG. 11, the embodiment of the loading device 1 is different in the example according to FIG. 12. The loading device 1 according to FIG. 12 also has a feeding space 2 which again has the form of a box open at its top. In the illustrated instance, the floor 11 of the feeding space 2 is flat and extends in an inclination and is formed by at least one conveyor belt 50' which, in the illustrated instance, forms the conveying device 5 of the feeding space 2. The conveying device 5 conveys pressing product inserted in the feeding space 2 in conveying direction 53 to the rotor roller 4 which, in the illustrated instance, is also disposed immediately in front of the loading opening 24 of the pressing chamber 22.

In addition to the conveying device 5, an auxiliary conveying device 60 is also provided in the example according to FIG. 12, said auxiliary conveying device 60 also being formed by a conveying roller 61 in correspondence with the example according to FIG. 11. Here as well, the conveying roller 61 is driveable in a direction of rotation which is opposite to the direction of rotation D of the rotor roller 4. By means of the conveying roller 61 of the auxiliary conveying device 60, the pressing product conveyed towards the pressing product reception region 7 by the conveying device 5 is reliably transferred into the engagement region of the rotor roller 4 which then transports the pressing product through the conveying channel 8 between the outer circumference of the rotor roller 4 and the guiding surface 10 and into the pressing chamber 22. Any undesired gliding or falling back of the pressing product which is transported into the pressing product reception region 7 by means of the conveying device 5, i.e. the conveyor belt 50' in the illustrated instance, is safely prevented by the conveying roller 61 of the auxiliary conveying device 60. As a result, the loading device 1 has a high conveying effect in this embodiment as well, so that it is ensured that a large quantity of pressing product is inserted into the pressing chamber 22 in a manner that is extremely uniform over time.

A drive 51' which is, appropriately, formed by an electric motor serves to drive the conveyor belt 50'. In order to achieve an equal conveying speed of the conveying device 5 and the auxiliary conveying device 60, the drives thereof can be coupled to each other mechanically or electrically.

Figure 13:
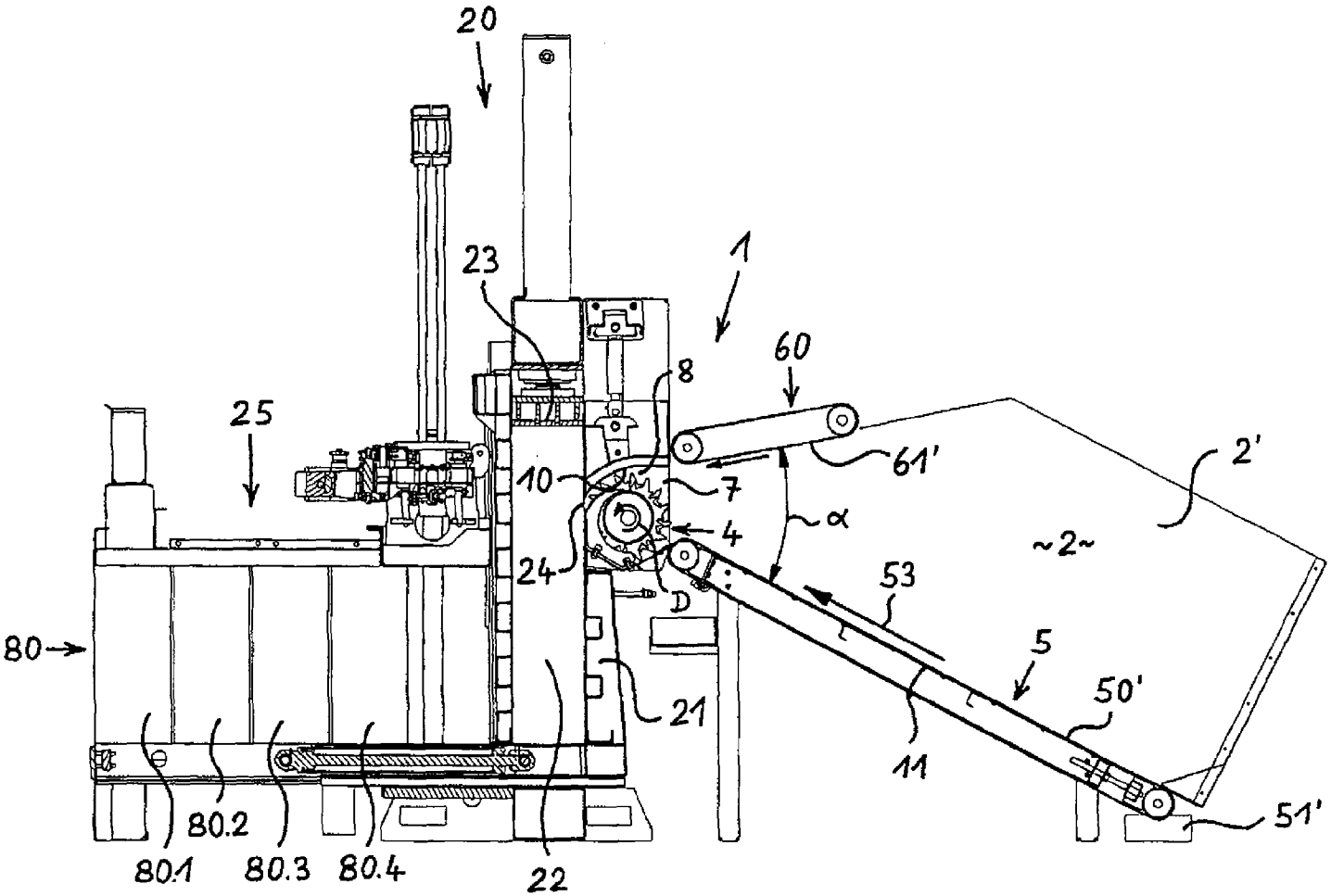
FIG. 13 is a vertical sectional view of the press having a loading device in a further embodiment.

FIG. 13 shows a further exemplary embodiment of a press 20 wherein the loading device 1 is once again modified. The press 20 as such having the storage space 25 corresponds to the examples according to FIGS. 11 and 12 already described above.

In the example according to FIG. 13, the loading device 1 also has a box-shaped feeding space 2 which is open at its top and has a lateral wall 2' visible in the background. In the illustrated instance, the floor 11 of the feeding space 2 is again formed by a conveyor belt 50' which forms the conveying device 5 of the feeding space 2. The conveyor belt 50' is again driven by the drive 51'.

The auxiliary conveying device 60 which is provided here as well now comprises a second conveyor belt 61' disposed above the conveyor belt 50'. Therein, the length of the conveyor belt 61' of the auxiliary conveying device 60 is only approximately a quarter to third of the length of the conveyor belt 50' forming the conveying device 5 in the feeding space 2. Moreover, FIG. 13 illustratively shows that the conveyor belt 50' and the conveyor belt 61' include with each other an acute angle $\alpha$ which is approximately 35° in the illustrated instance. This reduces the distance between the conveyor belts 50' and 61' as seen in the pressing product conveying direction 53, whereby a precompression of the supplied pressing product is obtained. In order to achieve an equal conveying speed of the conveyor belts 50' and 61', they can be coupled mechanically or electrically in terms of their drive.

In this exemplary embodiment, the auxiliary conveying device 60 which, in the illustrated instance, is formed by the conveyor belt 61' also prevents an undesired gliding or falling back of pressing product supplied by means of the conveying device 5 from the pressing product reception region 7 of the rotor roller 4 and instead causes the pressing product to be transferred into the engagement region of the rotor roller 4 in a precompacted and reliable manner. Here as well, the pressing product seized by the rotor roller 4 is conveyed through the conveying channel 8 between the outer circumference of the rotor roller 4 and the guiding surface 10 as well as through the loading opening 24 and into the pressing chamber 22.

As is illustratively shown in FIG. 13, the conveyor belt 61' forming the auxiliary conveying device 60 does not impede the placing or throwing of pressing product pieces into the feeding space 2 owing to its relatively short length, so that handling of the loading device 1 remains easy for operating personnel.

In the examples according to FIGS. 11 to 13, the loading device 1 is a part of a press 20; as an alternative, the illustrated loading device 1 can also be used by itself, e.g. for conveying and compacting purposes in case of lower pressing density requirements or for pretreating pressing product which is not intended to be finally compacted in a press immediately thereafter but only to be pretreated or subjected to further treatment in a different way than with presses.

Figure 14:
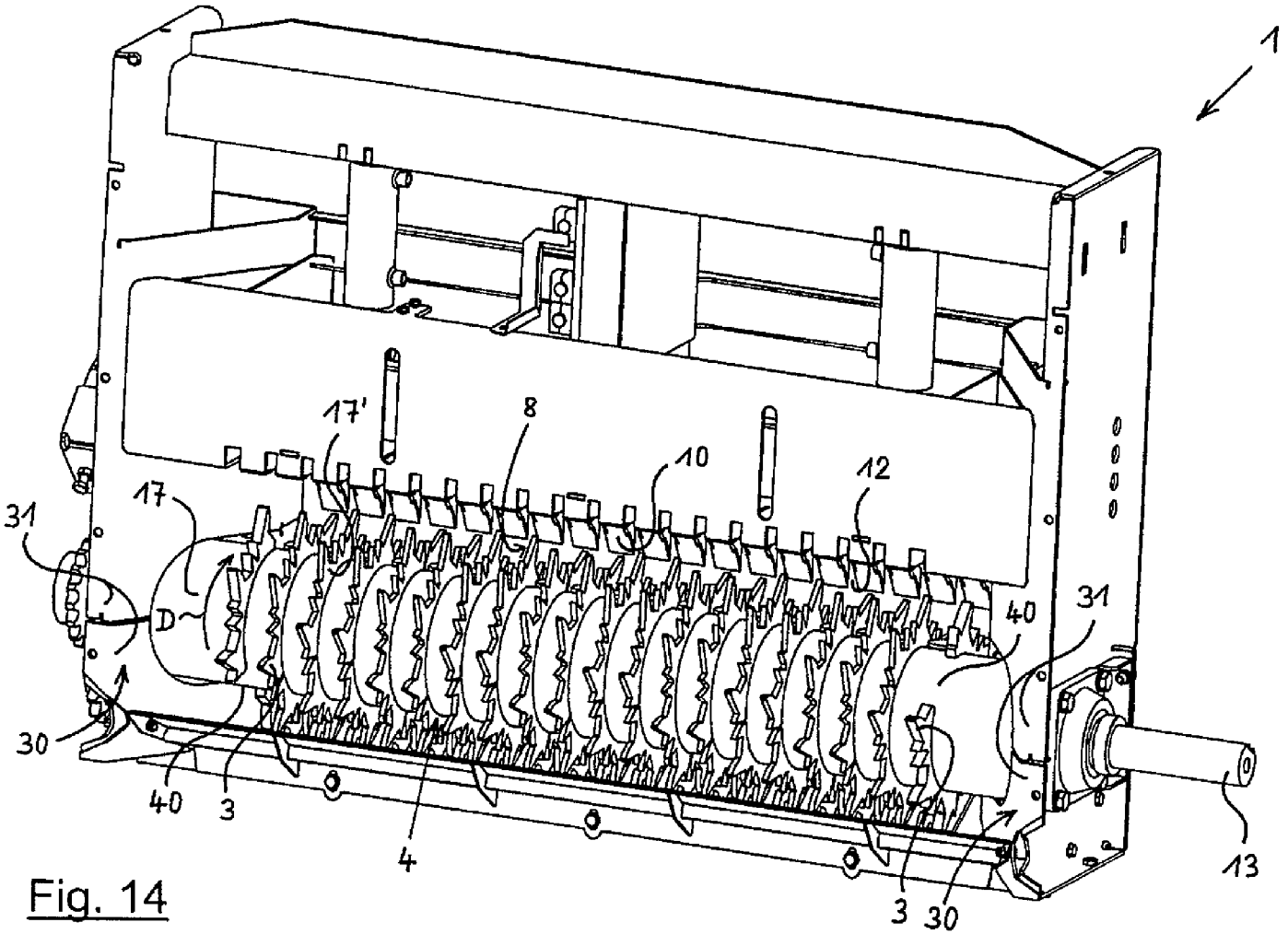
FIG. 14 is a perspective view of the loading device as such in a modified embodiment.
Figure 15:
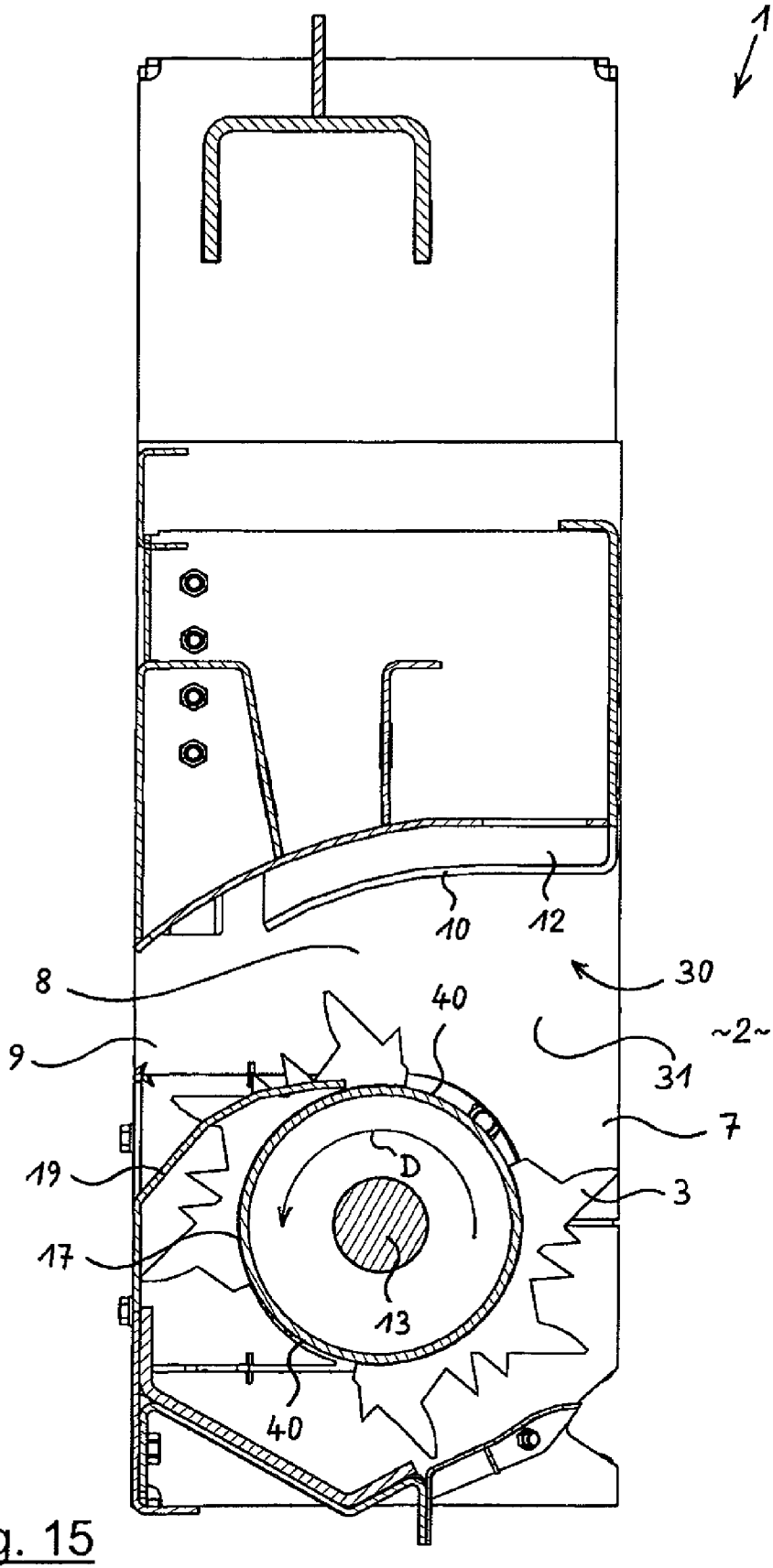
FIG. 15 is a vertical sectional view of the loading device shown in FIG. 14.

FIGS. 14 and 15 show a further development of the loading device 1 according to FIG. 9.

FIG. 14 is a perspective view of the front side of the loading device 1. The lower part of the loading device 1 is occupied by the rotor roller 4 which is mounted by means of its central shaft 13 such that it is rotatable both on the left and right. A rotary drive which is not visible here acts on the end of the central shaft 13 which is the left one in FIG. 14. The direction of rotation D of the rotor roller 4 is indicated by the rotary arrow near the left axial end of the rotor roller 4. Here as well, the rotor roller 4 has a jacket tube 17 extending coaxially with the central shaft 13. A plurality of disks 17' are disposed on the outer circumference of the jacket tube 17 in a non-rotatable manner and spaced apart from each other by an axial distance, said disks 17' each forming the conveying prongs 3 with their tips 3' in a radially outward direction.

The guiding surface 10 with its slots 12 in which the conveying prongs 3 can immerse is positioned above the rotor roller 4. In the illustrated instance, the guiding surface 10 is designed vertically adjustable and can be adjusted in vertical direction in relation to the rotor roller 4 and fixed in desired positions. In this manner, the distance between the outer circumference of the jacket tube 17 of the rotor roller 4 on the one hand and the surface of the guiding surface 10 facing the rotor roller 4 on the other hand is variable between a maximum distance as shown in FIG. 14 and a minimum distance approaching zero. In this manner, a conveying channel 8 with a variable channel width or height is formed between the rotor roller 4 and the guiding surface 10.

The stationary lateral guiding devices 30 having the form of the inclined guide walls 31 are disposed to the left and right of the axial end regions of the rotor roller 4. The guide walls 31 ensure that pressing product moved in conveying direction is directed to the center of the rotor roller 4 from the sides. This results in a compaction of the pressing product in the lateral edge regions, this leading to an improved and increased pressing product density in the lateral edge regions of the pressed bale produced in a subsequent pressing operation in an associated press which is not shown here.

In order to facilitate and support the directing of the pressing product to the center of the rotor roller 4, the rotor roller 4 has prongless circumferential sections 40 at each of its two axial end regions. Prongs 3 are not provided in these circumferential sections 40 so that moving pressing product from without inward towards the center of the rotor roller 4 is facilitated. Further circumferential sections having prongs 3 remain outside of the prongless circumferential sections 40 as seen in circumferential direction, so that a conveying effect of the rotor roller 4 on the pressing product present in the lateral edge region is still preserved here. In the example according to FIG. 14, two prongless circumferential sections 40 are formed in each of the two axially outer disks 17' having the prongs 3. As an alternative, it is also possible to form more disks 17' than one on each axially outer end, said disks 17' having one or a plurality of prongless circumferential sections 40.

FIG. 15 finally is a vertical sectional view of the loading device 1 shown in FIG. 14. The rotor roller 4 can be seen at the bottom of FIG. 15. The central shaft 13 of the rotor roller 4 extends in the center thereof. The jacket tube 17 extends concentrically with the central shaft 13. The disks 17' having the prongs 3 with their tips 3' are attached on the outer circumference of the jacket tube 17 in a non-rotatable manner. In the illustrated instance, the cutting plane extends immediately in front of the last disk 17' having prongs 3 which is positioned to the extreme right in FIG. 14, so that the two prongless circumferential sections 40 which are equally spaced apart from each other in circumferential direction and are disposed opposite to each other become distinctly visible in FIG. 15. The direction of rotation D of the rotor roller 4 is indicated by the rotary arrow provided thereon.

The guiding surface 10 having its slots 12 is disposed above the rotor roller 4 wherein, in the illustrated instance, the guiding surface 10 has its maximum distance from the rotor roller 4. The guiding surface 10 can be lowered towards the rotor roller 4 by means of appropriate guiding and adjusting means whereby the distance between the rotor roller 4 and the guiding surface 10 can be reduced to a minimum of approximately zero.

The region of the conveying channel 8 to the right in FIG. 15 forms the pressing product reception region 7 in which the rotor roller 4 receives the pressing product to be conveyed into the associated press and seizes said product with its prongs 3.

The conveying channel 8 through which pressing product can be conveyed out of the feeding space 2 which is positioned to the right of the loading device 1 to the left into the press not shown here, more precisely into the pressing chamber thereof, is formed between the upper side of the rotor roller 4 and the guiding surface 10.

The stripper arrangement 19 which ensures that the pressing product is reliably detached from the prongs 3 in the pressing product discharge region 9 and is thrown into the pressing chamber of the associated press can be recognized to the left of the rotor roller 4.

As is distinctly shown in FIG. 15, the guiding surface 10 extends in a curve—wherein the course of the guiding surface 10 is selected such that, in the course of the conveying channel 8, it results in a constriction of the conveying channel 8, i.e. a decreasing height, in conveying direction, i.e. from right to left according to FIG. 15. This causes the pressing product to be prepressed while it is running through the conveying channel 8.

Last but not least, one of the two guide walls 31 forming one of the lateral guiding devices 30 is still visible above the rotor roller 4 in the background of FIG. 15.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A press having a loading device, wherein the press has a press housing comprising a pressing chamber, and having a loading opening for feeding a pressing product, wherein the loading device comprises at least one rotatably driveable rotor roller equipped with conveying prongs, said rotor roller being disposed directly in front of or in the loading opening of the press, and wherein the loading device has a feeding space connected upstream of the rotor roller, wherein:

the press has a pressing shield which is displaceable in the pressing chamber by means of a mechanical drive in a pressing direction extending from top to bottom and back, a curved guiding surface extends above the rotor roller, which is spaced apart from the rotor roller in a variable manner, and the rotor roller and the guiding surface together form a conveying channel ending in the pressing chamber with a directional component pointing in the pressing direction of the pressing shield.

2. The press according to claim 1, wherein the loading opening has a width which is equal to an inner width of the pressing chamber and wherein a part of the rotor roller that is equipped with conveying prongs has an axial length which is equal to the width of the loading opening, as measured parallel to the rotor roller.

3. The press according to claim 2, wherein the feeding space has a width as measured parallel to the rotor roller, which is equal to the width of the loading opening.

4. The press according to claim 2, wherein the feeding space has a width as measured parallel to the rotor roller, which is in excess of the width of the loading opening and wherein one lateral guiding device each is allocated to each end face region of the rotor roller, wherein pressing product is guided from lateral edge regions of the feeding space towards an inner region by means of said lateral guiding devices.

5. The press according to claim 4, wherein the rotor roller has at least one prongless circumferential section in its equipment of conveying prongs in each of its axial end regions, as seen in circumferential direction.

6. The press according to claim 4, wherein each guiding device is designed as a passive device and is each formed by one inclined guide wall which is disposed upstream of the rotor roller.

7. The press according to claim 4, wherein each guiding device is designed as an active device and is each formed by a conveyor screw section which is disposed on the rotor roller at the axial end regions thereof.

8. The press according to claim 1, wherein the conveying prongs of the rotor roller are formed by disks which are attached onto a jacket tube of the rotor roller in a non-rotatable manner and are spaced apart from each other axially, said disks being toothed or serrated in a radially outward direction.

9. The press according to claim 1, wherein the feeding space is formed by a box which is open at its top and has an opening towards the rotor roller at its side facing the loading opening of the press.

10. The press according to claim 1, wherein the feeding space has a flat floor and wherein the conveying device is formed by a conveying shield linearly displaceable in the feeding space by means of a mechanical drive.

11. The press according to claim 1, wherein the feeding space has a floor that is curved in the form of a cylinder jacket section and wherein the conveying device is formed by a conveying shield that can be swiveled in the feeding space by means of a mechanical drive, the swivel axis of said conveying shield coinciding with a central axis of the cylinder jacket section.

12. The press according to claim 1, wherein the conveying device comprises an arrangement of at least one driveable conveyor chain.

13. The press according to claim 12, wherein the at least one conveyor chain is, at least in part, equipped with carrier tools.

14. The press according to claim 1, wherein the conveying device comprises a driveable scraper floor conveyor.

15. The press according to claim 1, wherein the conveying device comprises driveable conveyor screws.

16. The press according to claim 1, wherein an auxiliary conveying device is disposed above the conveying device spaced apart therefrom and, as seen in the pressing product conveying direction, upstream of the rotor roller, said auxiliary conveying device exerting at least one of a conveying effect and a compressing effect on the upper side of the pressing product supplied by the conveying device.

17. The press according to claim 16, wherein the auxiliary conveying device is formed by at least one conveying roller.

18. The press according to claim 17, wherein the conveying roller has a textured surface at its circumference.

19. The press according to claim 17, wherein the conveying roller has a surface provided with a friction-increasing covering at its circumference.

20. The press according to claim 18, wherein the texture of the surface of the conveying roller is formed by one of conveying strips, conveying fingers and conveying prongs.

21. The press according to claim 18, wherein the texture of the surface of the conveying roller is formed by a conveying roller jacket extending in an undulating or zigzagging manner as seen in the circumferential direction of the conveying roller.

22. The press according to claim 16, wherein the auxiliary conveying device is formed by at least one conveyor belt.

23. The press according to claim 22, wherein the conveyor belt forming the auxiliary conveying device has a length which is less than half of a conveying length of the conveying device.

24. The press according to claim 22, wherein the conveyor belt forming the auxiliary conveying device forms an acute angle with the pressing product conveying direction of the conveying device, with the distance of the conveyor belt from the conveying device becoming smaller in the pressing product conveying direction.

25. The press according to claim 16, wherein the conveying device and the auxiliary conveying device are arranged to be driven with the same conveying speed.

26. The press according to claim 25, wherein the conveying device and the auxiliary conveying device have a common branching drive.

27. The press according to claim 16, wherein the position of the auxiliary conveying device is adjustable at least in vertical direction in relation to the conveying device.

28. The press according to claim 16, wherein the auxiliary conveying device is connected to the remaining loading device via detachable connecting means in a removable manner.

29. The press according to claim 1, wherein slots are provided in the guiding surface, with the conveying prongs immersing in said slots during the rotation of the rotor roller over at least a part of their length.

30. The press according to claim 1, wherein the guiding surface comprises individual guiding plates which are set spaced apart from each other.

31. The press according to claim 1, wherein a curve radius of the curved guiding surface is approximated to a curve radius of a jacket tube of the rotor roller, at least in a pressing product discharge region.

32. The press according to claim 31, wherein a bending radius of the guiding surface is continuously decreasing from a feeding-space-sided beginning of the guiding surface to the pressing-chamber-sided end thereof, as seen in pressing product conveying direction.

33. The press according to claim 1, wherein at least one stripper arrangement cooperating with the conveying prongs of the rotor roller is provided at the loading device.

34. The press according to claim 33, wherein the stripper arrangement forms a cage around the rotor roller and wherein, in part, the rotor roller extends inside this cage.

35. The press according to claim 34, wherein the rotor roller extends over a circumferential region positioned in the pressing product discharge region, said circumferential region comprising 40 to 60 percent of the circumference of the rotor roller and being arranged inside the cage formed by the stripper arrangement.

36. The press according to claim 33, wherein the stripper arrangement comprises individual strippers set spaced apart from each other.

37. The press according to claim 33, wherein the stripper arrangement is formed by stripping prongs going up to the rotor roller and attached to a holding device, said stripping prongs cooperating with the conveying prongs.

38. The press according to claim 37, wherein the surface of the conveying prongs and the surface of the stripping prongs form an angle of 90° in relation to each other.

39. The press according to claim 29, wherein the conveying prongs have such a length that, with a maximum adjustable distance between the guiding surface and the rotor roller, the conveying prongs of the rotor roller just immerse in the slots.

40. The press according to claim 1, wherein a minimum distance between the guiding surface on the one hand and the rotor roller or a jacket tube of the rotor roller on the other hand approaches zero in a pressing-chamber-sided pressing product discharge region.

41. The press according to claim 33, wherein the stripper arrangement is adjustably spaced apart from the guiding surface or from the rotor roller.

42. The press according to claim 33, wherein stationary knives in cutting cooperation with the conveying prongs are disposed at the guiding surface or at the stripper arrangement, said knives allowing cutting the pressing product open or up.

43. The press according to claim 42, wherein at least a part of the conveying prongs is formed as knives, or wherein knives are provided on the rotor roller in addition to the conveying prongs, said knives cooperating with the stationary knives.

44. The press according to claim 1, wherein a retaining element is provided, which is movable between a disabling position separating the feeding space from the pressing product reception region of the rotor roller and an enabling position connecting the feeding space to the pressing product reception region of the rotor roller.

45. The press according to claim 44, wherein the retaining element is one of a retaining plate, a retaining grating and a retaining comb which is movable in front of the rotor roller by at least one of sliding, swiveling and turning towards.

46. The press according to 44, wherein the retaining element is provided with a mechanical drive.

47. The press according to claim 1, wherein the press is one of a baling press, a briquetting press, and part of a press container.

* * * * *